US010986442B2

(12) United States Patent
Ohura

(10) Patent No.: US 10,986,442 B2
(45) Date of Patent: Apr. 20, 2021

(54) WEARABLE SPEAKER AND REPRODUCTION APPARATUS

(71) Applicant: SONY CORPORATION, Tokyo (JP)

(72) Inventor: Yoshikazu Ohura, Tokyo (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 16/344,186

(22) PCT Filed: Nov. 8, 2017

(86) PCT No.: PCT/JP2017/040286
§ 371 (c)(1),
(2) Date: Apr. 23, 2019

(87) PCT Pub. No.: WO2018/110161
PCT Pub. Date: Jun. 21, 2018

(65) Prior Publication Data

US 2019/0320258 A1 Oct. 17, 2019

(30) Foreign Application Priority Data

Dec. 16, 2016 (JP) ..... JP2016-244363

(51) Int. Cl.
*H04R 1/34* (2006.01)
*H04R 1/02* (2006.01)

(52) U.S. Cl.
CPC ..... *H04R 1/345* (2013.01); *H04R 1/02* (2013.01)

(58) Field of Classification Search
CPC ..... H04R 1/345; H04R 1/02
USPC ..... 381/334, 74, 309, 87, 335
See application file for complete search history.

(56) References Cited

U.S. PATENT DOCUMENTS 4,284,844 A * 8/1981 Belles ..... H04R 1/2834 181/151
2014/0126760 A1 5/2014 Tse et al.
2015/0156572 A1* 6/2015 Li ..... H04R 1/28 381/386
2016/0205459 A1* 7/2016 Kamada ..... H04R 29/001 381/74

FOREIGN PATENT DOCUMENTS

CN 102811409 A 12/2012
CN 204482016 U 7/2015
CN 105474663 A 4/2016
JP 06-178384 A 6/1994
JP 2007-235929 A 9/2007
JP 2015-037246 A 2/2015

OTHER PUBLICATIONS

International Search Report and Written Opinion of PCT Application No. PCT/JP2017/040286, dated Jan. 30, 2018, 07 pages of ISRWO.
Office Action for CN Patent Application No. 201780069574.6, dated Sep. 2, 2020, 07 pages of Office Action and 09 pages of English Translation.

* cited by examiner

*Primary Examiner* — Paul Kim
*Assistant Examiner* — Douglas J Suthers
(74) *Attorney, Agent, or Firm* — Chip Law Group

(57) ABSTRACT

A wearable speaker includes a pair of speaker boxes that are attached on both ends of an attached band and a speaker unit and a passive radiator that are attached on each of the speaker boxes. The attached band is a neck hanging unit that is attachable on a neck of a user of the wearable speaker.

10 Claims, 22 Drawing Sheets

WEARABLE SPEAKER AND REPRODUCTION APPARATUS

CROSS REFERENCE TO RELATED APPLICATIONS

This application is a U.S. National Phase of International Patent Application No. PCT/JP2017/040286 filed on Nov. 8, 2017, which claims priority benefit of Japanese Patent Application No. JP 2016-244363 filed in the Japan Patent Office on Dec. 16, 2016. Each of the above-referenced applications is hereby incorporated herein by reference in its entirety.

TECHNICAL FIELD

The present technology relates to a wearable speaker and a reproduction apparatus.

BACKGROUND ART

When listening to music through headphones, the sound may be localized in the center of the head, which causes discomfort and fatigue in some cases. A speaker apparatus, e.g., a stationary speaker apparatus does not cause such a problem. However, there has been a problem that such a speaker cannot be carried or a person other than the listener may hear the sound. In consideration of such a point, a neck-hung speaker apparatus has been proposed (see, for example, the following Patent Literature 1).

CITATION LIST

Patent Literature

Patent Literature 1: Japanese Patent Application Laid-open No. 1994-178384

DISCLOSURE OF INVENTION

Technical Problem

It is desired to compensate for low-frequency components of sound that tend to be insufficient and provide low-frequency feeling or realistic feeling to a user even in a compact acoustic reproduction system such as a neck-hung speaker apparatus.

The present technology has been made in view of such problems, and it is an object of the present invention to provide a wearable speaker and a reproduction apparatus capable of providing low-frequency feeling or realistic feeling to a user even in an acoustic reproduction system smaller than a stationary speaker apparatus.

Solution to Problem

The present technology is, for example, a wearable speaker, including:

a pair of speaker boxes that are attached on both ends of an attached band; and a speaker unit and a passive radiator that are attached on each of the speaker boxes.

The present technology is, for example, a reproduction apparatus, including:

a signal processing unit that processes an audio signal; and a wearable speaker, in which the wearable speaker includes a pair of speaker boxes that are attached on both ends of an attached band, and a speaker unit and a passive radiator that are attached on each of the speaker boxes.

Advantageous Effects of Invention

In accordance with at least one embodiment of the present technology, it is possible to provide low-frequency feeling and realistic feeling to a user. It should be noted that the effect described here is not necessarily limitative and may be any effect described in the present disclosure. Further, the content of the present technology is not interpreted restrictively by the exemplified effects.

BRIEF DESCRIPTION OF DRAWINGS

FIGS. 1A, 1B, 1C, and 1D are each a schematic diagram used for describing deviation of relative positions of a speaker and an ear in forward and backward directions.

FIG. 2A is a schematic diagram used for describing deviation of relative positions of the speaker and the ear in forward and backward directions, which is caused by the thickness of the shoulder of the listener, and FIG. 2B is a schematic diagram used for describing deviation of relative positions of the speaker and the ear in right and left directions.

FIGS. 3A, 3B, 3C, and 3D are each a schematic diagram for describing that sound changes depending on the relative positions of the speaker and the ear when the speaker is placed upward.

FIGS. 4A, 4B, and 4C are each a schematic diagram for describing a method of improving directivity in the case where the speaker is directed to the outside in the right and left directions.

FIGS. 5A and 5B are each a schematic diagram for describing a method of improving directivity in the case where the speaker is directed to the outside in the right and left directions.

FIGS. 6A, 6B, and 6C are each a schematic diagram used for describing a solution method of variations and changes in positions of the ear in forward and backward directions

FIGS. 7A, 7B, and 7C are each a schematic diagram used for describing a solution method of inclination of a speaker box, which is caused by the thickness of the shoulder of the listener.

FIGS. 8A, 8B, 8C, and 8D are respectively a perspective view, a top view, a front view, and a side view in which a right-side plate is removed, which are used for describing outline of the present technology.

FIGS. 9A and 9B are respectively a front view and a perspective view used for describing outline of the present technology.

FIG. 10 is a perspective view showing an appearance example of a neck speaker according to one embodiment.

FIG. 11 is a diagram showing an attached status of the neck speaker according to one embodiment.

FIG. 12 is a diagram showing a configuration example of the neck speaker according to one embodiment.

FIG. 13 is a diagram showing a configuration example of the neck speaker according to one embodiment.

FIGS. 14A, 14B, and 14C is a are diagrams showing a configuration example of the neck speaker according to one embodiment.

FIG. 15 is a diagram showing a configuration example of a passive radiator according to one embodiment.

FIG. 16 is a block diagram for describing an electrical configuration example of the neck speaker according to one embodiment.

FIGS. 17A, 17B, 17C, and 17D are each a diagram for describing an example of an effect achieved by providing the passive radiator.

FIGS. 18A and 18B are each a diagram for describing an example of an effect achieved by providing the passive radiator.

FIG. 19 is a diagram for describing a modified example.

FIG. 20 is a diagram for describing a modified example.

FIGS. 21A and 21B are each a diagram for describing a modified example.

MODE(S) FOR CARRYING OUT THE INVENTION

Figure 1A:
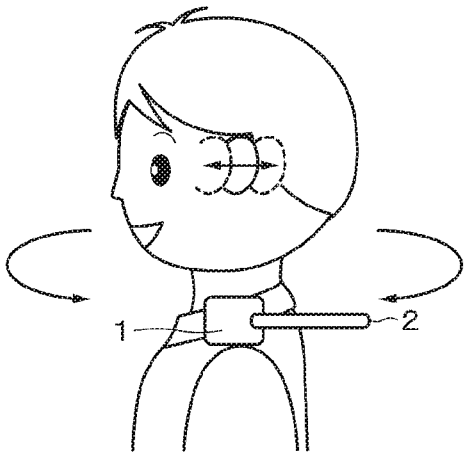
[FIGS. 1A, 1B, 1C, and 1D]
Figure 1B:
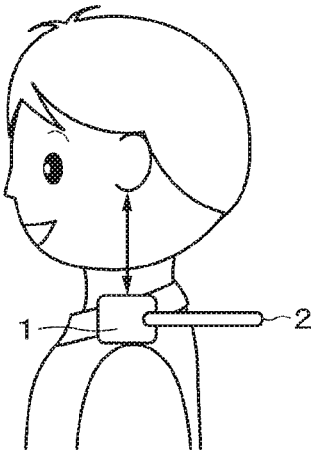
Figure 1C:
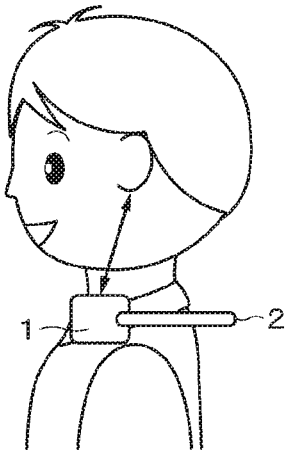
Figure 1D:
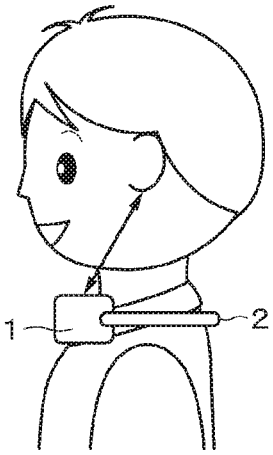

Hereinafter, an embodiment and the like of the present technology will be described with reference to the drawings. Note that descriptions will be made in the order described below.

<1. Problem Requiring Consideration about Neck Speaker>
<2. Description of Outline of Present Technology>
<3. Embodiment>
<4. Modified Example>

The embodiment and the like described below are preferable specific examples of the present technology, and content of the present technology is not limited to the embodiment and the like.

Moreover, hereinafter, to prevent illustration from being complicated, only a part of a structure will sometimes be denoted by reference symbols, and a part of a structure will sometimes be simplified and shown.

1. Problem Requiring Consideration about Neck Speaker

As an example of the neck speaker, a speaker apparatus where left and right speaker boxes on which left and right speaker units are attached are attached on both ends of a band for neck hanging will be considered. In other words, the one speaker box is put on each of the left and right shoulders of a listener respectively, and sounds from the speaker are radiated upward such that the listener may listen to the sounds with the left and right ears.

In the case of the speaker apparatus having such a configuration, as shown in FIGS. 1A, 1B, 1C, and 1D, there is a problem that the relative positions of the right and left speakers and the ears of the listener are not fixed. In order to place a speaker box 1 on the shoulder, it is necessary to have a means for stably fixing this on the shoulder, and designs or methods in which the speaker box 1 does not fall or deviate even when the listener slightly moves are necessary. This is possible by a method such as attaching two speaker box 1 to both ends of a curved band 2 passing behind the neck, and hanging it on the neck.

However, as shown in FIGS. 1A, 1B, 1C, and 1D, the relative positions of the speaker and the ear change differ depending on the person due to the physical size of the listener (specifically, thickness of the shoulder), and the relative positions of the speaker and the ear change just in the case where the speaker box 1 is placed on a deviated position of the shoulder or the listener shakes his/her head. The variation in relative positions of the speaker and the ear and the change in frequency characteristics cause differences in the volume of sound that enters the ear and how it sounds, it is difficult to achieve a speaker that sounds good even if anyone hears it, and there is a problem that the sound changes and deteriorates when the listener shakes his/her head.

Regarding the amount of variation in the speaker and the ear in forward and backward directions, the position of the ear moves back and forth by approximately ±3 cm when the speaker shakes his/her head lightly. The diameter of a small person's neck is 4 cm, and the diameter of a big person's neck is not less than 8 cm. With reference to the back of the neck, the difference between them is not less than 4 cm. By adding the change 6 cm caused when the speaker shakes his/her head thereto, the position of the ear changes by not less than 10 cm.

Figure 2A:
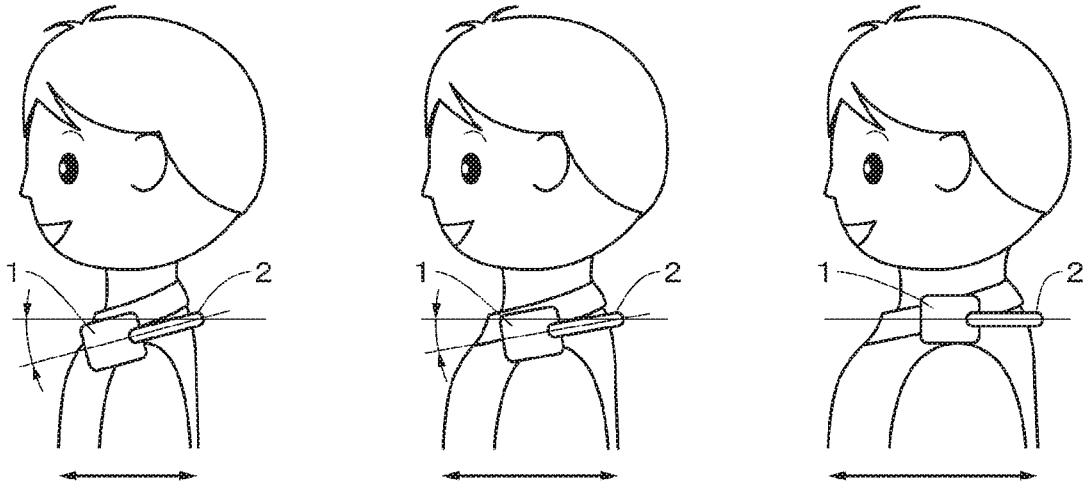
[FIGS. 2A and 2B]
Figure 2B:
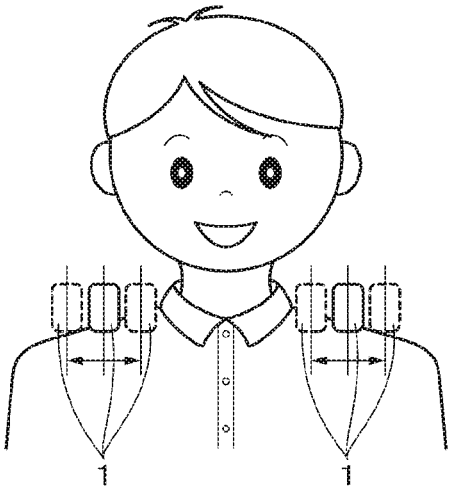

Also the width of the shoulder affects the problem that the relative positions of the speaker and the ear are not fixed. As shown in FIG. 2A, in the case of a method such as hanging it on the neck, the angle of the speaker box 1 with respect to the horizontal direction changes by the thickness of the shoulder, and the speaker box 1 tilts forward as the width of the shoulder is narrower. Part A of FIG. 2A shows an example in which the thickness of the shoulder increases sequentially from the listener on the leftmost side to the listener on the rightmost side in the figure. The height from the shoulder to the ear differs depending on the listener. Considering also this fact, larger variations occur in the relative positions of the speaker and the ear. Also the position of the speaker on the shoulder affects the problem that the relative positions of the speaker and the ear are not fixed. As shown in FIG. 2B, in the case of a method such as hanging it on the neck, the relative positions change also depending on the position of the shoulder on which the speaker box 1 is placed in the right and left directions. The height from the shoulder to the ear differs depending on the listener. Considering also this fact, larger variations occur in the relative positions of the speaker and the ear.

Figure 3A:
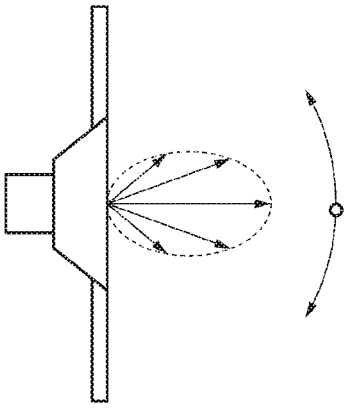
[FIGS. 3A, 3B, 3C, and 3D]
Figure 3C:
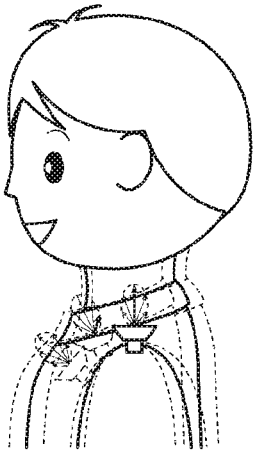
Figure 3B:
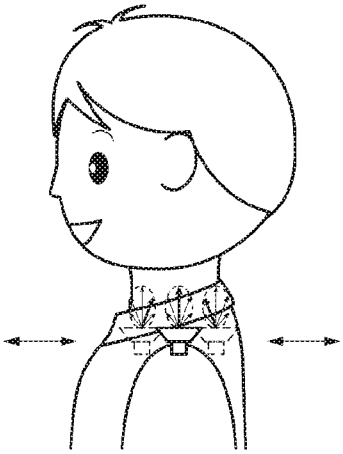
Figure 3D:
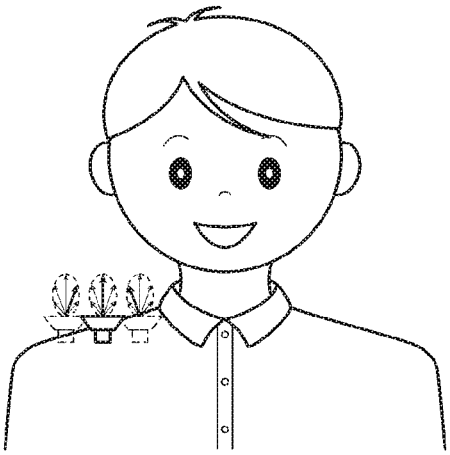

The fact that the sound changes by variations in the relative positions of the speaker and the ear of the listener as described above will be described with reference to FIGS. 3A, 3B, 3C, and 3D. As shown in FIG. 3A, the speaker has directivity. With reference to the listening position of the speaker in the front direction, the sound pressure decreases as it deviates from the front direction, and the frequency characteristics in the high frequency range change. Further, between the sound from the front of the ear and the sound from behind the ear, the sound pressure and the timbre change in accordance with the position of the speaker by the influence of the positional relationship between ear pinnae and ear canal, and how it sounds changes. Due to these two factors, the sound changes depending on the relative positions of the speaker and the ear in the case where the speaker is placed on the shoulder upward. FIG. 3B shows the characteristic change due to the difference in the position in forward and backward directions, FIG. 3C shows the characteristic change due to the difference in the thickness of the shoulder, and FIG. 3D shows the characteristic change due to the difference in the position in the right and left directions.

If the function of adjusting the position and angle of the speaker box 1 is provided, it is possible to solve the problem of sound change due to the difference in physique. However, there is still a problem, for example, when the listener shakes his/her head. Further, it takes time and effort for the user to make adjustment, and learning is necessary for performing optimum adjustment. Therefore, it is an object of the present technology to provide a speaker apparatus in which the timbre is less likely to change due to variations in the relative positions of the speaker and the ear.

Figure 4A:
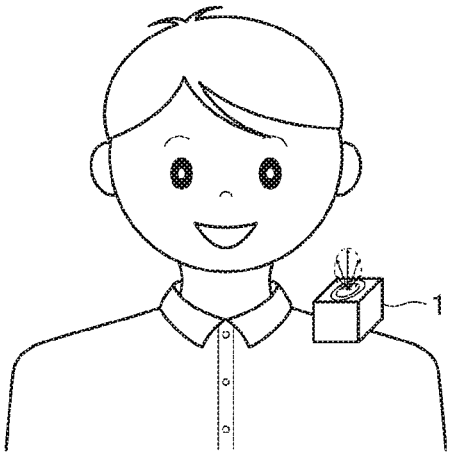
[FIGS. 4A, 4B, and 4C]
Figure 4B:
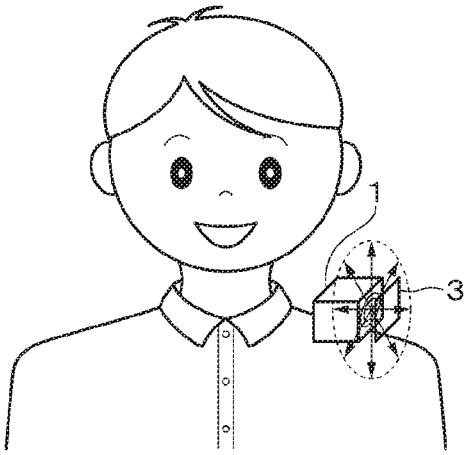
Figure 4C:
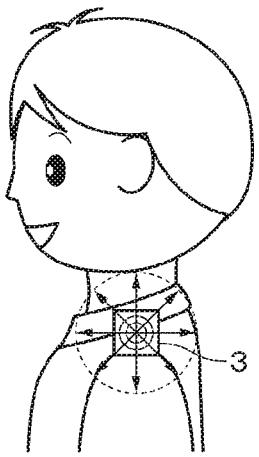

As shown in FIG. 4A, in the case where the speaker box 1 is placed on the shoulder of the listener with the sound radiation surface of the speaker box 1 directed upward, the timbre changes due to variations in the relative positions of the speaker and the ear as described above. In this regard, as shown in FIG. 4B and FIG. 4C, the radiation direction of the sound of the speaker box 1 (i.e., the axial direction of the speaker unit) is made substantially horizontal so that the sound is radiated outward from the speaker box 1, and a reflection plate 3 is provided on the front surface of the cone diaphragm of the speaker box 1. Sound is emitted from the gap between the speaker box 1 and the reflection plate 3. In this way, regarding the sound emitted from the gap, there is substantially no influence of the directivity at the positions where the distances from the position (center position) of the speaker axis are equal to each other, and the characteristic change can be reduced in forward and backward directions. Further, the characteristic change due to the thickness of the shoulder of the listener can be reduced.

2. Description of Outline of Present Technology

Figure 5B:
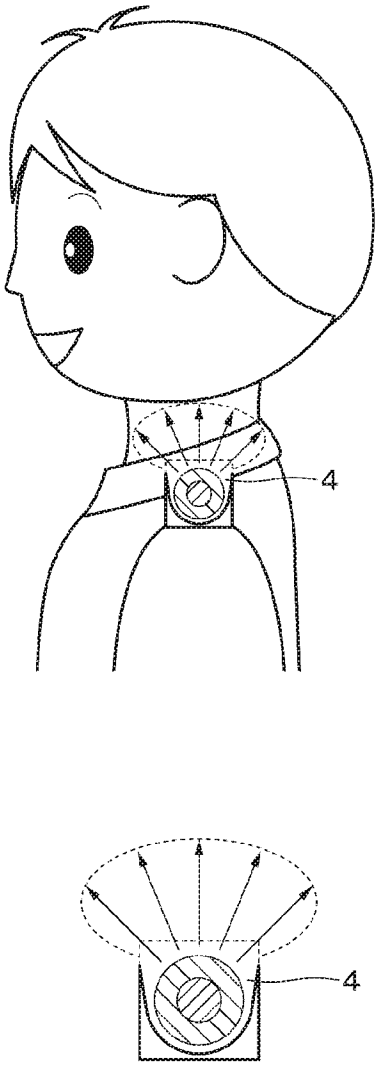
[FIGS. 5A and 5B]
Figure 5A:
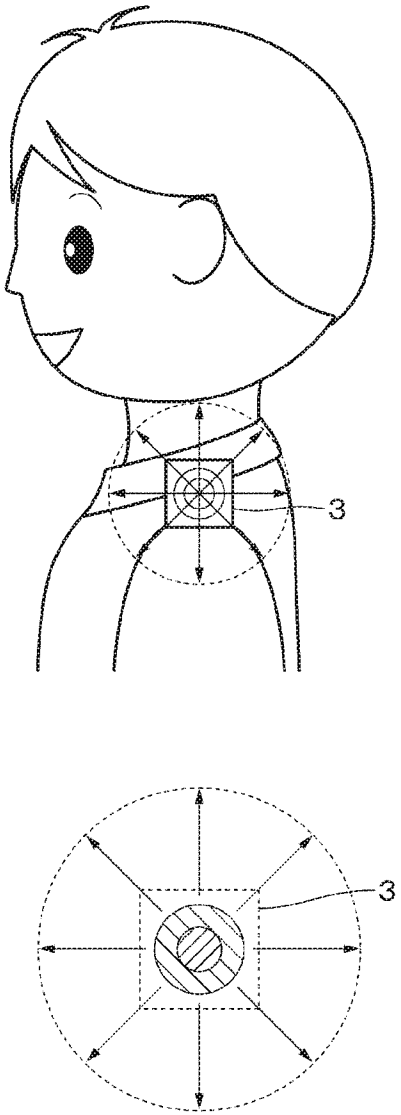

However, as shown in FIG. 5A, in the case where the radiation direction of the sound is changed by the reflection plate 3, the sound is emitted in the direction of 360 degrees, and the energy of the sound is wasted. Further, mainly the sound that has been emitted downward is reflected on the shoulder or the like and disturbs the sound quality, and sound leakage to the surroundings also increases. In this regard, as shown in FIG. 5B, a semicircular recess 4 that causes the sound of the speaker to be directed upward is formed. The recess 4 has a shape in which the upper side is opened and the lower half is closed in a semicircular shape. With the recess 4, it is possible to cause the sound of the speaker to be directed upward (in the direction of the ear of the listener), and prevent the energy of the sound from being wasted.

Figure 6C:
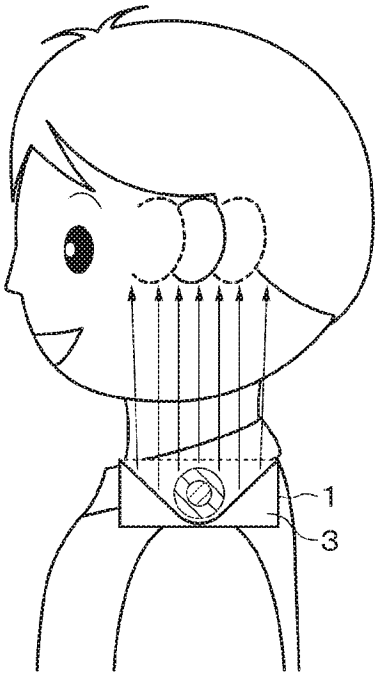
[FIGS. 6A, 6B, and 6C]
Figure 6B:
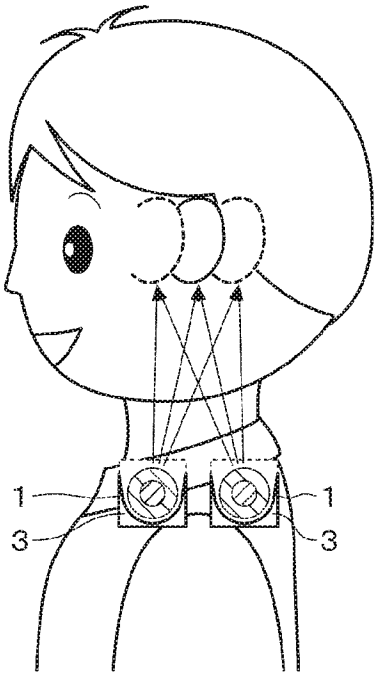
Figure 6A:
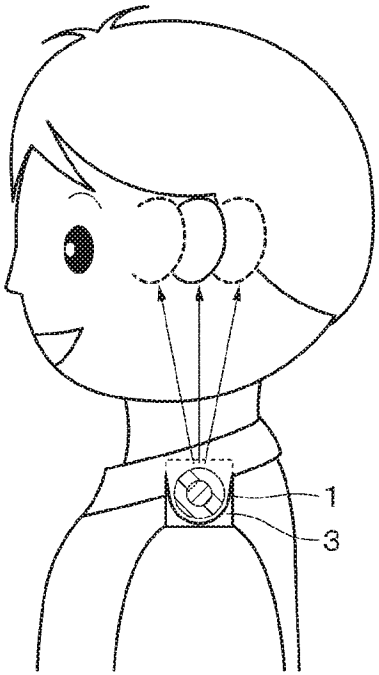

As described above, although the problem of the directivity of the speaker in forward and backward directions is solved, as it is, there is still a problem of variations in the position the ear in forward and backward directions as shown in FIG. 6A. As one solution method, as shown in FIG. 6B, two speaker boxes 1 (speakers) are arranged in forward and backward directions. This method has a drawback that frequency interference occurs between the two speakers, the frequency characteristics change, and the frequency characteristics change depending on the relative positions of the speakers and the ear. As a more favorable solution method, as shown in FIG. 6C, by extending the speaker box 1 and the reflection plate 3 in forward and backward directions to prolong the aperture unit, it is possible to make the sound output to the upward direction uniform in forward and backward directions.

As described above, a difference in inclination of the speaker box 1 in the forward direction is generated due to the difference in the width of the shoulder, or the like. In the case of placing the speaker box 1 on the shoulder with the rear part of the neck as a fulcrum, and placing the speaker box 1 horizontally on the shoulder of the listener as shown in FIG. 7A, the position of the speaker box 1 is likely to be unstable. For this reason, if the speaker box 1 is designed to tilt forward to some extent from the beginning as shown in FIG. 7B, it is possible to stably attach the speaker box 1 on the shoulder. In this regard, if the speaker box 1 tilts forward while the speaker unit is placed at the center of the box, the center position (most favorable position) of the range of the sound in forward and backward directions deviates from the direction of the ear.

Figure 7C:
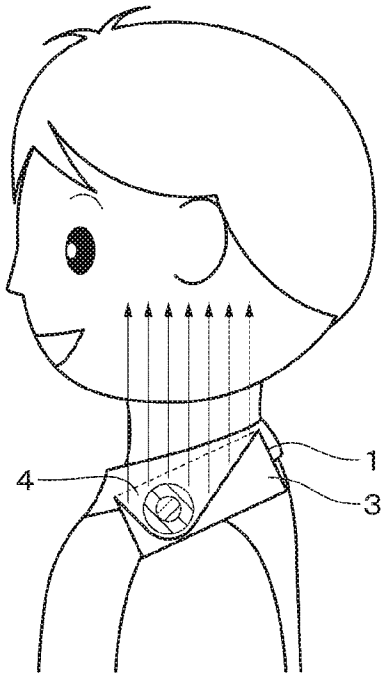
[FIGS. 7A, 7B, and 7C]
Figure 7B:
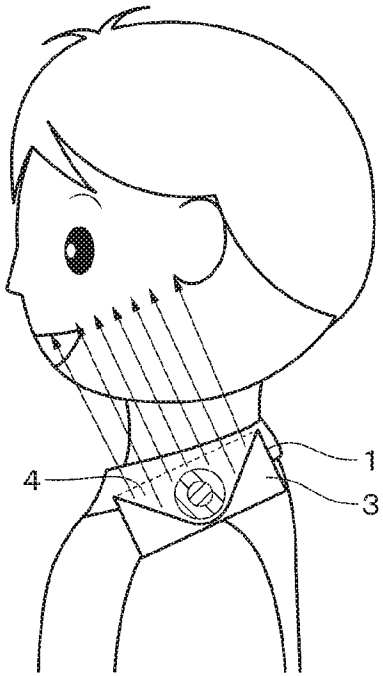
Figure 7A:
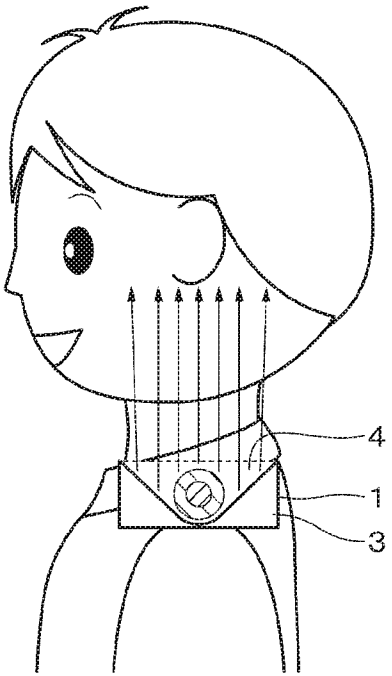

In this regard, as shown in FIG. 7C, the position of the speaker unit is moved forward from the center position of the speaker box 1 in forward and backward directions, and the shape of the recess 4 is set accordingly. In other words, the recess 4 has a shape in which the width in the height direction is narrowed from the region facing the speaker unit toward the front side and the back side. With such a configuration, the range of the sound having good characteristics shifts behind the speaker box 1, and the direction of the sound can be adjusted to the direction of the ear. Further, with this configuration, it is possible to not only achieve stable attachment because a heavy speaker unit is located in front of the point at which the shoulder as a fulcrum and the box are in contact with each other, but also alleviate the variation in inclination of the speaker box 1 due to the difference in the width of the shoulder because the best range of the sound in which the speaker unit is separated from the ear widens. If the listener warped the body later, the speaker apparatus falls in the case where the weighted position of the speaker unit, which is a heavy object, is behind the fulcrum. However, in the case where the speaker unit is located in front, the weighted position is not moved behind the fulcrum unless the listener warps the body more, thereby making it difficult for the speaker apparatus to fall.

Figure 8A:
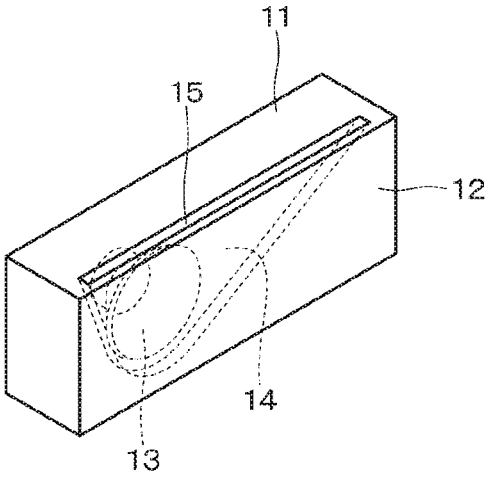
[FIGS. 8A, 8B, 8C, and 8D]
Figure 8B:
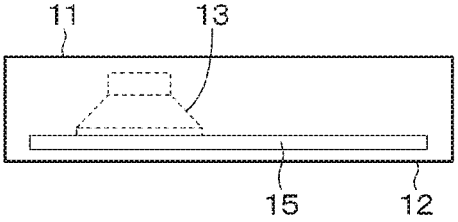
Figure 8C:
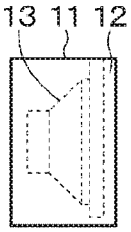
Figure 8D:
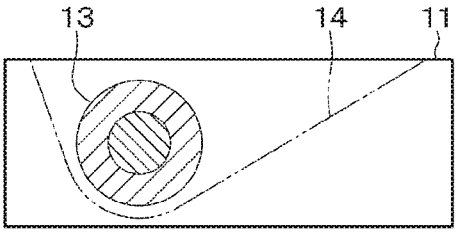

As a result of the consideration described above, one of a right channel speaker apparatus and a left channel speaker apparatus according to one embodiment of the present technology, e.g., a right channel speaker apparatus has a configuration as schematically shown in FIGS. 8A, 8B, 8C, and 8D. In the configuration shown in FIGS. 8A, 8B, 8C, and 8D, the speaker box 1 and the reflection plate 3 are integrally formed with a common case 11 formed by resin molding. FIG. 8A is a perspective view of the speaker apparatus, FIG. 8B is a top view of the speaker apparatus, FIG. 8C is a front view of the speaker apparatus, and FIG. 8D is a side view of the speaker apparatus in which a right-side plate 12 is removed. In FIG. 8D, the shape of a recess 14 is represented by a long dashed double-short dashed line. Note that the reflection plate 3 (the right-side plate 12) and the corn surface of the speaker unit do not necessarily need to be in parallel to each other, and the reflection plate 3 may be oblique so as to expand upward.

As an example, a speaker unit 13 is a dynamic speaker including a cone diaphragm, and is attached to a baffle plate parallel to the right-side plate 12. The recess 14 for guiding the sound upward is formed on the surface of the right-side plate 12 facing the diaphragm of the speaker unit 13, and a slit 15 is formed above the recess 14. The recess 14 and the slit 15 constitute a sound guiding unit. The recess 14 is formed so that the region facing the diaphragm of the speaker unit 13 has the maximum width in the height direction and the width gradually decreases toward the front side and back side of the right-side plate. The slit 15 is formed above the recess 14.

Figure 9A:
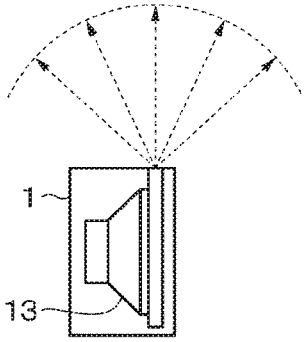
[FIGS. 9A and 9B]
Figure 9B:
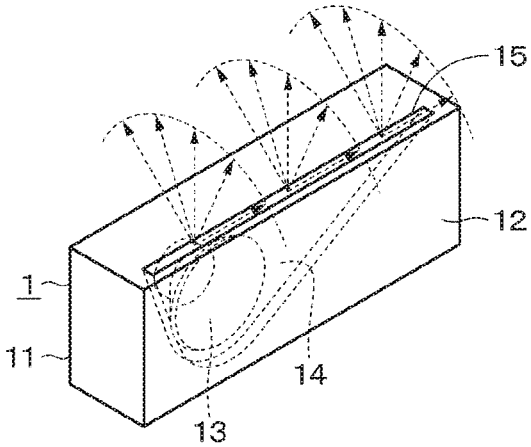

The outlet of the sound of the speaker box 1 is the slit 15. In accordance with general physical law, a diffraction phenomenon occurs. As shown in FIG. 9A and FIG. 9B, sound waves uniform in the right and left directions are emitted as compared with the case where the speaker is directed upward. Therefore, it is possible to reduce the change in how it sounds even in the case where the position where the speaker box 1 is placed deviates in the right and left directions. There have been several speakers to be placed on the neck or the shoulder. In any of these speakers, basically, the sound quality/volume changes due to deviation of the position. In particular, in the case where speakers are arranged on the right and left in the stereo, the balance between sound quality and volume on the right and left is likely to collapse, and it has been difficult to listen to the sound of high sound quality. In accordance with the present technology, since the changes in sound quality and volume due to deviation of the position are suppressed, it is possible to realize a neck speaker with better sound quality to be hung on the neck or placed on the shoulder, in the sound itself or sound making. Further, since the sound field is collected in the direction of the ear, sound leakage to the surroundings can be relatively reduced.

As an example, the slit 15 favorably has a length of not less than 8 cm in forward and backward directions of the listener. The width of the slit 15 is set to approximately 4 mm to 25 mm. For example, the width is 6 mm. Further, in order to prevent foreign matters such as garbage, dust, and liquid from entering from the slit 15, the slit 15 may be covered with a punch plate (plate with fine holes), cloth, or the like. Further, a support column for maintaining the width of the slit 15 may be added. Further, instead of the slit 15, an aperture having a shape such as an elliptical hole may be formed.

3. Embodiment

Hereinafter, an embodiment of the present technology will be described in detail. An embodiment of the present technology will be described by using a neck speaker as an example of a wearable speaker apparatus (hereinafter, appropriately referred to as wearable speaker). Note that the wearable speaker is, for example, a speaker apparatus having a size that can be carried, which is to be placed around (in the vicinity of) a human body.

Example of Outer Appearance of Neck Speaker

Figure 10:
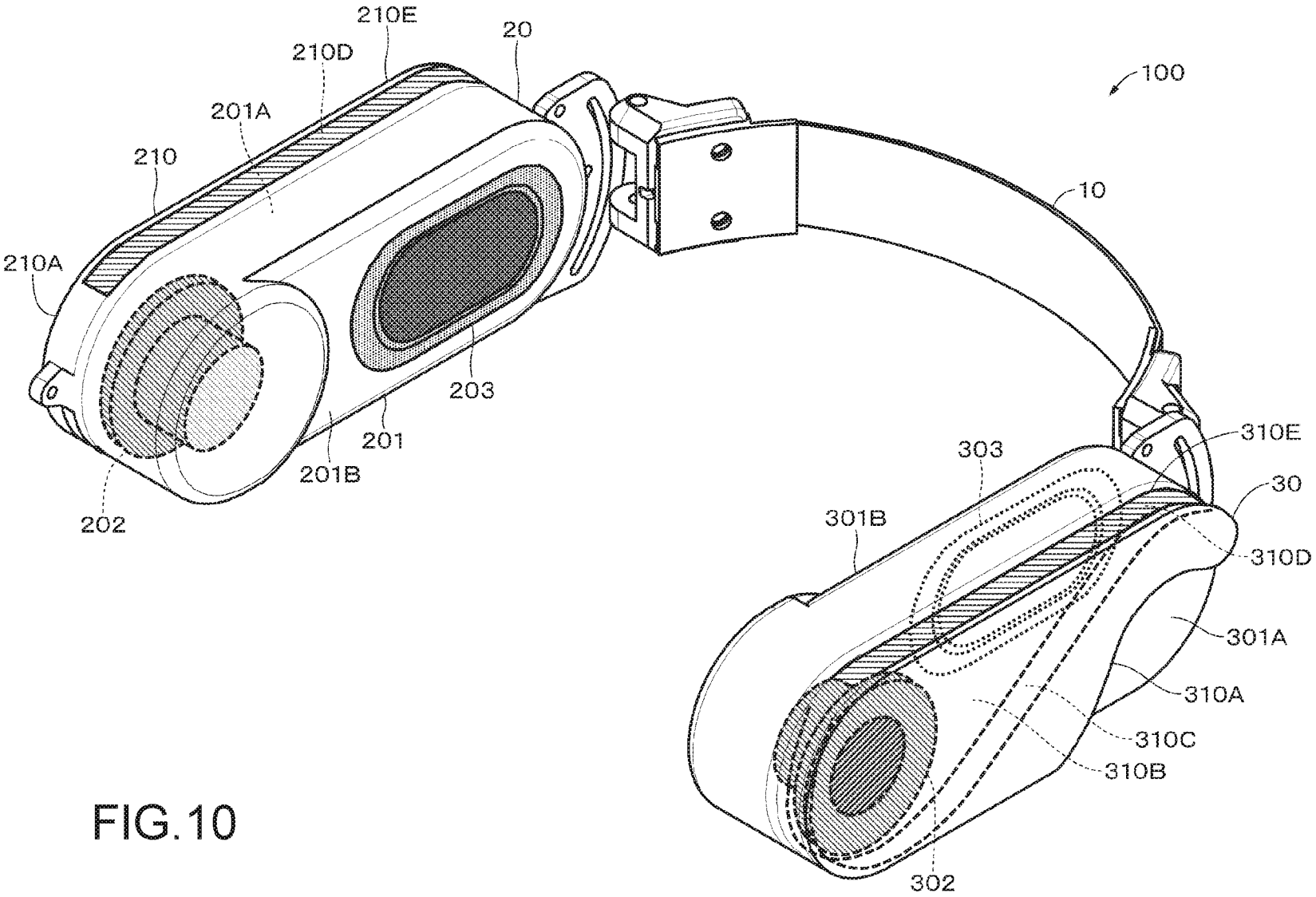
[FIG. 10]

FIG. 10 is a perspective view showing an outer appearance of a neck speaker 100 according to an embodiment. The neck speaker 100 includes a neck hanging unit 10 as an example of an attached band, a right-side speaker unit 20 connected to one end side of the neck hanging unit 10, and a left-side speaker unit 30 connected to the other end side of the neck hanging unit 10. The neck speaker 100 constitutes a two-channel audio reproduction system as a whole.

Figure 11:
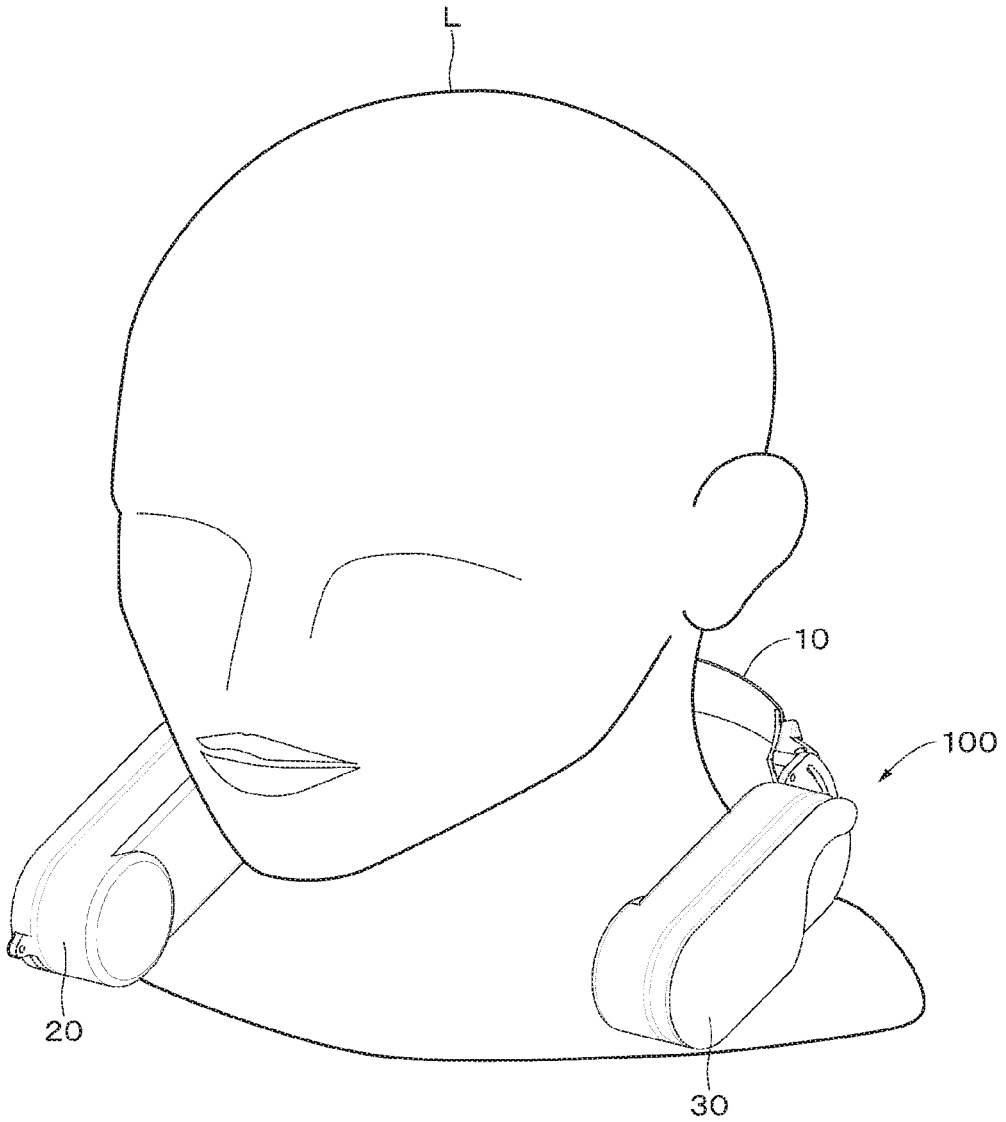
[FIG. 11]

As shown in FIG. 11, for example, the neck speaker 100 is used in a status where the neck hanging unit 10 is hung on the back side of the neck of a listener L, the right-side speaker unit 20 is brought into contact with (placed on) the vicinity of the right shoulder of the listener L, and the left-side speaker unit 30 is brought into contact with the vicinity of the left side of the listener L. At this time, the opposite side (hereinafter, referred to as tip side) to the connection point of the right-side speaker unit 20 with the neck hanging unit 10 slightly tilts toward the front of the listener L. Similarly, the tip side of the left-side speaker unit 30 slightly tilts toward the front of the listener L. The sound is reproduced from the neck speaker 100 in an attached status shown in FIG. 11. The sound only needs to be bearable by a person's ear, such as human voice and music.

Note that in the following description, directions such as upward and downward directions, forward and backward directions, right and left direction, inside and outside directions, a horizontal direction, and a vertical direction are defined with reference to the listener L in the attached status of the neck speaker 100.

Configuration Example of Neck Speaker

Figure 12:
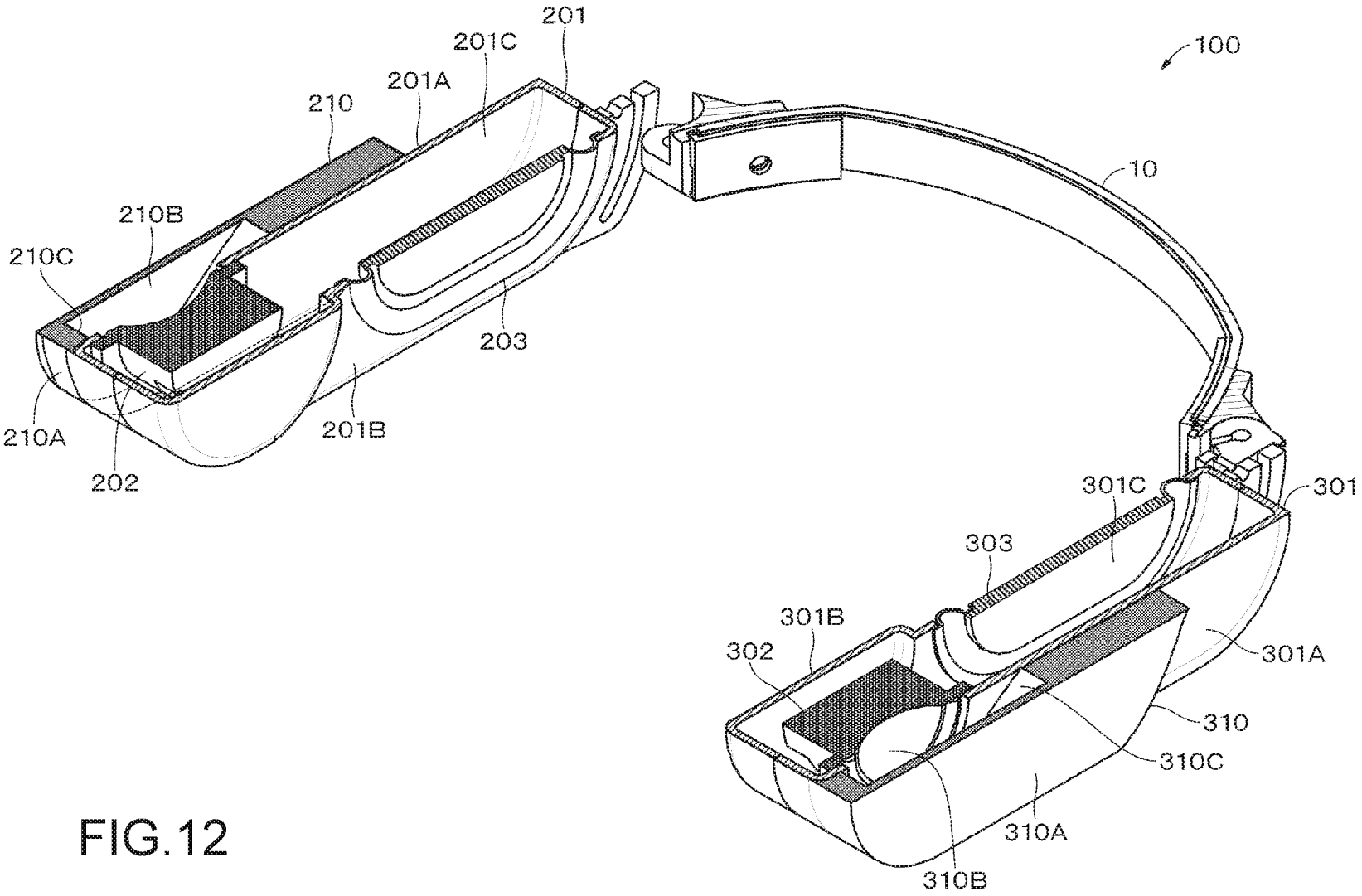
[FIG. 12]
Figure 13:
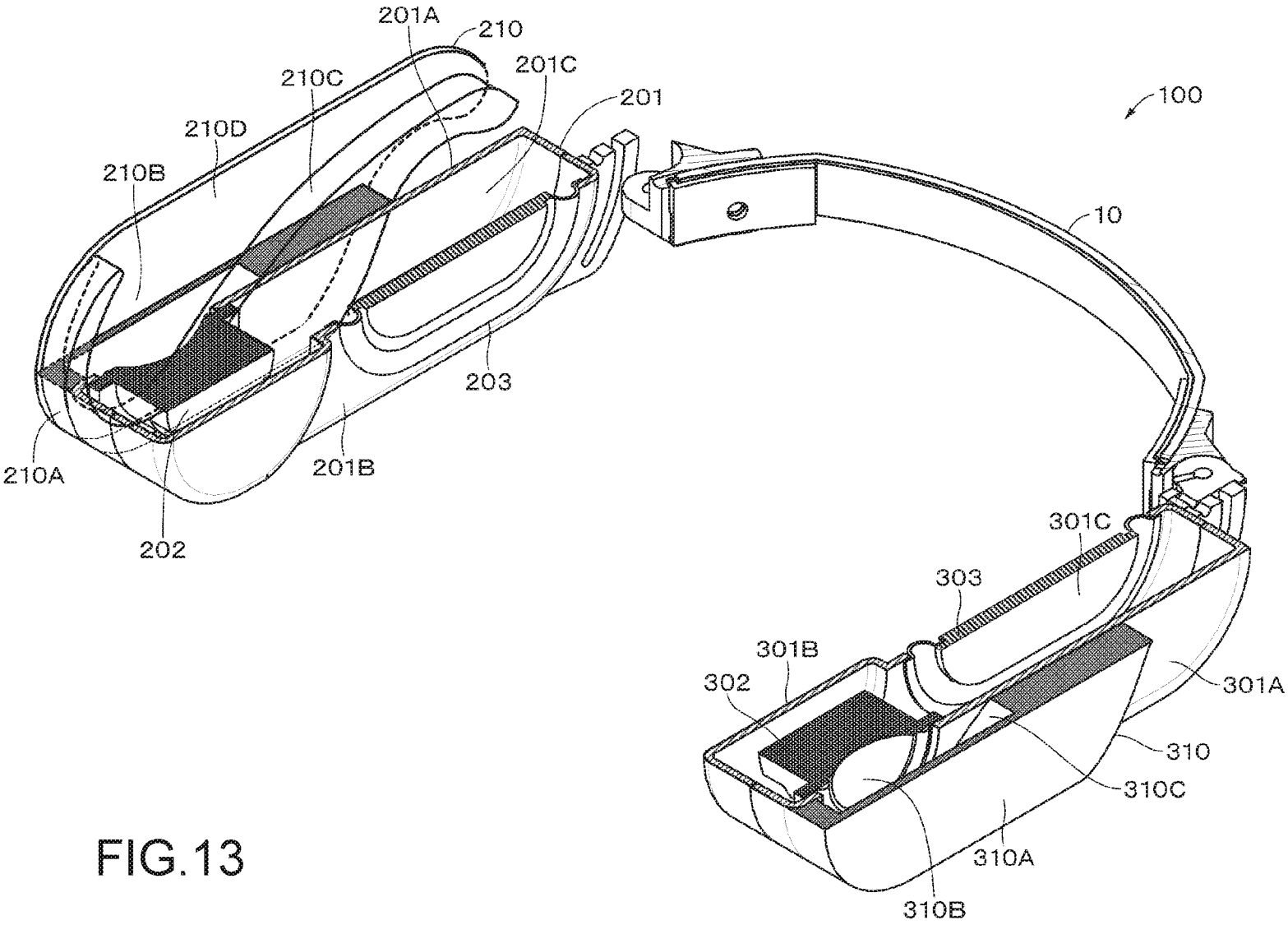
[FIG. 13]
Figure 14A:
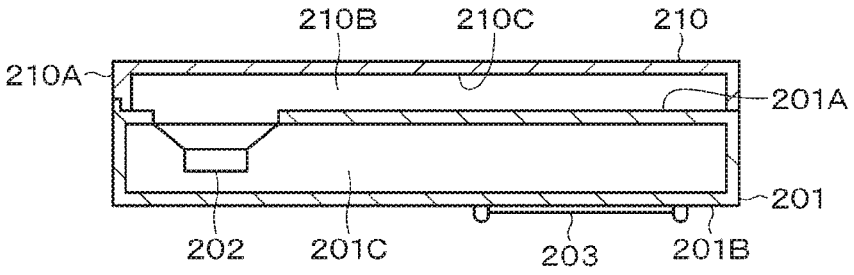
[FIGS. 14A, 14B, 14C]
Figure 14B:
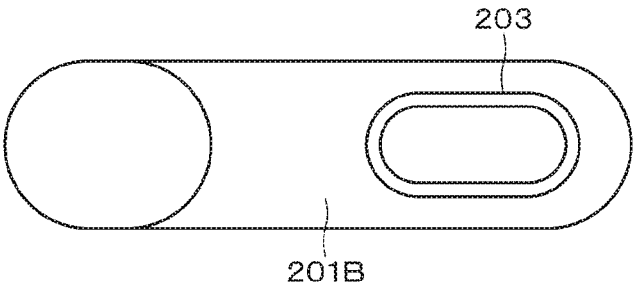
Figure 14C:
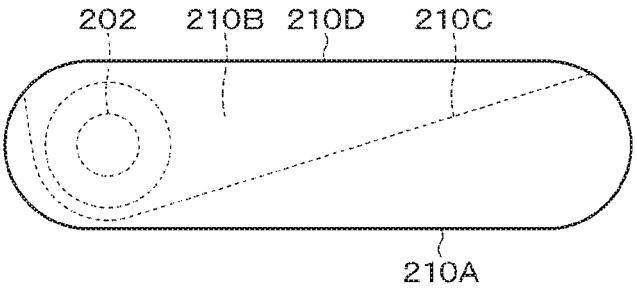
Figure 15:
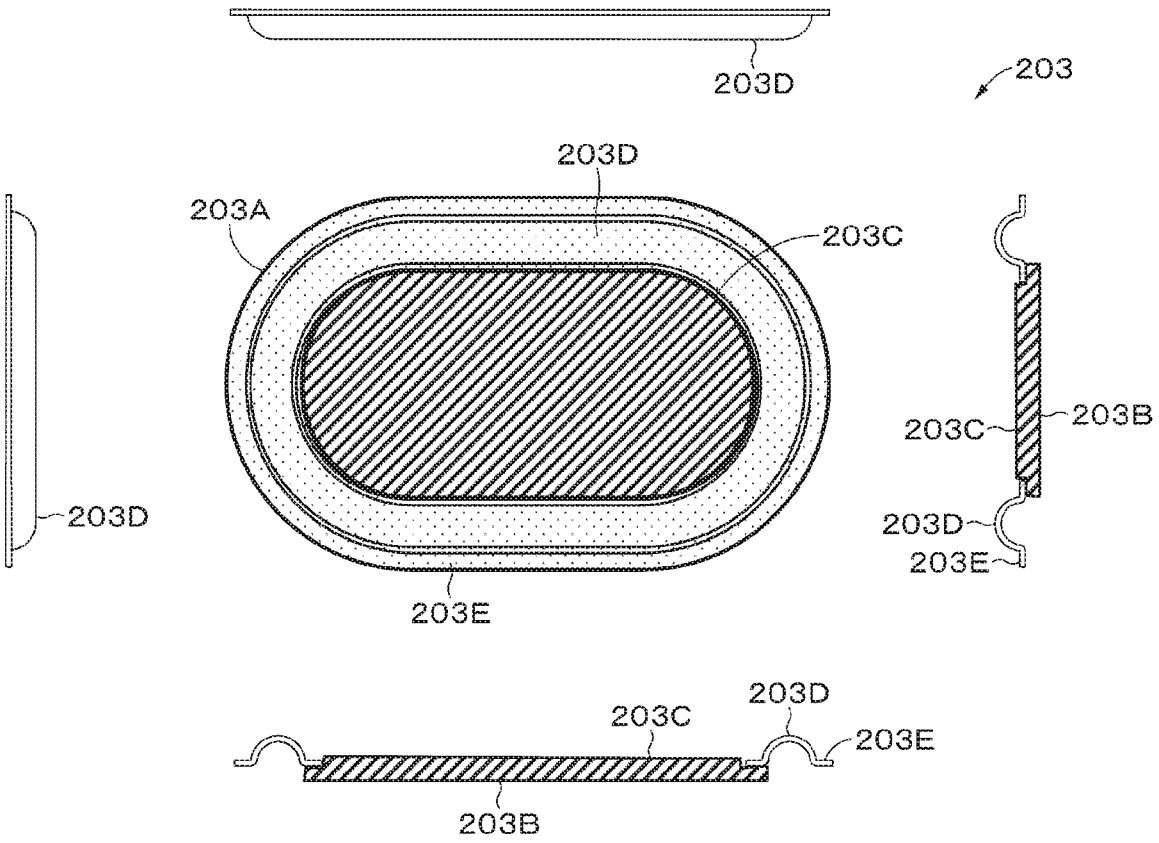
[FIG. 15]

Next, a configuration example of the neck speaker 100 will be specifically described with reference to also FIGS. 12, 13, 14A, 14B, 14C, and 15 in addition to FIG. 10. FIG. 12 is a partial cross-sectional view showing an internal configuration example of the right and left speaker units. FIG. 13 is a diagram showing the relationship between the overall view of the neck speaker 100 shown in FIG. 10 and the partial cross-sectional view of the neck speaker 100 shown in FIG. 12. FIG. 14A is a diagram for describing an internal configuration example of the right-side speaker unit 20, FIG. 14B is a diagram of the right-side speaker unit 20 viewed from inside, and FIG. 14C is a diagram for describing a configuration example of a sound guiding unit described below. FIG. 15 is a diagram showing a configuration example of a passive radiator of the neck speaker 100.

The neck hanging unit 10 has a U-shape in a plan view. The neck hanging unit 10 is formed of, for example, resin, and has flexibility. A part of the neck hanging unit 10 may contain metal. For example, when the operation of separating the right-side speaker unit 20 and the left-side speaker unit 30 from each other is performed, the interval between the right-side speaker unit 20 and the left-side speaker unit 30 can be expanded in accordance with the operation.

The right-side speaker unit 20 includes a speaker box 201, a full-range dynamic speaker unit 202, a passive radiator 203, and a sound guiding unit 210.

The speaker box 201 is formed of, for example, resin, and has a box-like shape. The speaker box 201 has a surface 201A facing outward in the attached status, and a side surface 201B opposite to the side surface 201A, which faces inward in the attached status. The side surfaces 201A and 201B each have such a shape that two opposing sides in a rectangle are replaced with a semicircle, and form a track-like shape such as an athletics stadium.

In the speaker box 201, an audio space 201C is formed. The speaker unit 202 is attached to the side surface 201A of the speaker box 201. Specifically, the speaker unit 202 is attached to a position shifted to the front side from the center position of the side surface 201A in forward and backward directions.

The passive radiator 203 is attached to the side surface 201B of the speaker box 201. Specifically, the passive radiator 203 is attached to a position shifted to the back side (closer to the neck hanging unit 10) from the center position of the side surface 201B in forward and backward directions The passive radiator 203 includes a main body 203A, a diaphragm 203B attached to the main body 203A, and a weight (not shown) attached to the diaphragm. The main body 203A is formed by using vulcanized rubber or non-vulcanized rubber such as isobutene-isoprene rubber (IIR) and acrylonitrile-butadiene rubber (NBR).

As shown in FIG. 15, the main body 203A includes a flat part 203C formed substantially at the center, a substantially track-shaped edge 203D formed around the flat part 203C, and a substantially track-shaped outer peripheral part 203E formed around the edge 203D. The diaphragm 203B is attached to the back surface (surface located inside the speaker box 201) of the flat part 203C. A weight for making the mass of the drive system including the diaphragm 203B constant is attached to the back surface of the diaphragm 203B.

The cross section of the edge 203D has a substantially semicircular shape protruding toward the outside of the speaker box 201. The outer peripheral part 203E is attached to a frame (not shown), and the passive radiator 203 is attached to the side surface 201B of the speaker box 201 via the frame. Note that the passive radiator 203 shown in FIG. 15 is an example, and a passive radiator having a shape (e.g., a circular shape) different from the illustrated shape may be used.

The sound guiding unit 210 includes a casing 210A, a sound guiding space 210B that is formed in the casing 210A and connected to the sound radiation surface of the speaker unit 202, a wall unit 210C forming the sound guiding space 210B, and an aperture unit 210D that radiates sound from the sound guiding space 210B. For example, the configuration including the sound guiding space 210B and the wall unit 210C corresponds to the configuration including the recess and the reflection plate (right-side plate) described above. Further, the aperture unit 210D corresponds to the above-mentioned slit.

The casing 210A has, for example, a box-like shape in which the length (thickness) in upward and downward directions decreases from the front side to the back side. The casing 210A is attached to the speaker box 201 via a screw, vis, or the like. Note that the speaker box 201 and the casing 210A may be integrally formed.

A part of the wall unit 210C gently tilts so as to rise from the front side (tip) to the back side (back end) so that the length of the sound guiding space 210B in the height direction decreases from the front side to the back side corresponding to the shape of the casing 210A.

The aperture unit 210D has a rectangular shape in a plan view, and is formed to extend along the longitudinal direction of the casing 210A. As described above, the length of the aperture unit 210D in forward and backward directions is set to, or example, not less than 8 cm, and the width of the aperture unit 210D in the right and left directions is set to, for example, 4 mm to 25 mm. However, the present technology is not limited thereto. In order to prevent foreign matters such as garbage, dust, and liquid from entering the sound guiding space 210B, the aperture unit 210D is covered with a protective member 210E such as a net and cloth (see FIG. 10). The aperture unit 210D itself may be configured in a fine lattice shape to suppress contamination of foreign matters.

Also the left-side speaker unit 30 has substantially the same configuration as that of the right-side speaker unit 20. The left-side speaker unit 30 includes a speaker box 301, a full-range dynamic speaker unit 302, a passive radiator 303, and a sound guiding unit 310.

The speaker box 301 is formed of, for example, resin, and has a box-like shape. The speaker box 301 has a surface 301A facing outward in the attached status, and a side surface 301B opposite to the side surface 301A, which faces inward in the attached status. The side surfaces 301A and 301B form a track-like shape such as an athletics stadium.

In the speaker box 301, an audio space 301C is formed. The speaker unit 302 is attached to the side surface 301A of the speaker box 301. Specifically, the speaker unit 302 is attached to a position shifted to the front side from the center position of the side surface 301A in forward and backward directions.

The passive radiator 303 is attached to the side surface 301B of the speaker box 301. Specifically, the passive radiator 303 is attached to a position shifted to the back side (closer to the neck hanging unit 10) from the center position of the side surface 301B in forward and backward directions.

Although detailed illustration is omitted, the passive radiator 303 includes a main body, a diaphragm attached to the main body, and a weight attached to the diaphragm, similarly to the passive radiator 203. The main body is formed by using vulcanized rubber or non-vulcanized rubber such as isobutene-isoprene rubber (IIR) and acrylonitrile-butadiene rubber (NBR).

The main body includes a flat part formed substantially at the center, a substantially track-shaped edge formed around the flat part, and a substantially track-shaped outer peripheral part formed around the edge. The diaphragm is attached to the back surface (surface located inside the speaker box 301) of the flat part. A weight for making the mass of the drive system including the diaphragm constant is attached to the back surface of the diaphragm.

The cross section of the edge has a substantially semicircular shape protruding toward the outside of the speaker box 301. The outer peripheral part is attached to a frame (not shown), and the passive radiator 303 is attached to the side surface 301B of the speaker box 301 via the frame.

The sound guiding unit 310 includes a casing 310A, a sound guiding space 310B that is formed in the casing 310A and connected to the sound radiation surface of the speaker unit 302, a wall unit 310C forming the sound guiding space 310B, and an aperture unit 310D that radiates sound from the sound guiding space 310B. For example, the configuration including the sound guiding space 310B and the wall unit 310C corresponds to the configuration including the recess and the reflection plate (right-side plate) described above. Further, the aperture unit 310D corresponds to the above-mentioned slit.

The casing 310A has, for example, a box-like shape in which the length (thickness) in upward and downward directions decreases from the front side to the back side. The casing 310A is attached to the speaker box 301 via a screw, vis, or the like. Note that the speaker box 301 and the casing 310A may be integrally formed.

A part of the wall unit 310C gently tilts so as to rise from the front side (tip) to the back side (back end) so that the length of the sound guiding space 310B in the height direction decreases from the front side to the back side corresponding to the shape of the casing 310A.

The aperture unit 310D has a rectangular shape in a plan view, and is formed to extend along the longitudinal direction of the casing 310A. As described above, the length of the aperture unit 310D in forward and backward directions is set to, or example, not less than 8 cm, and the width of the aperture unit 310D in the right and left directions is set to, for example, 4 mm to 25 mm. However, the present technology is not limited thereto. In order to prevent foreign matters such as garbage, dust, and liquid from entering the sound guiding space 310B, the aperture unit 310D is covered with a protective member 310E such as a net and cloth (see FIG. 10). The aperture unit 310D itself may be configured in a fine lattice shape to suppress contamination of foreign matters.

[Electrical Configuration of Neck Speaker]

Figure 16:
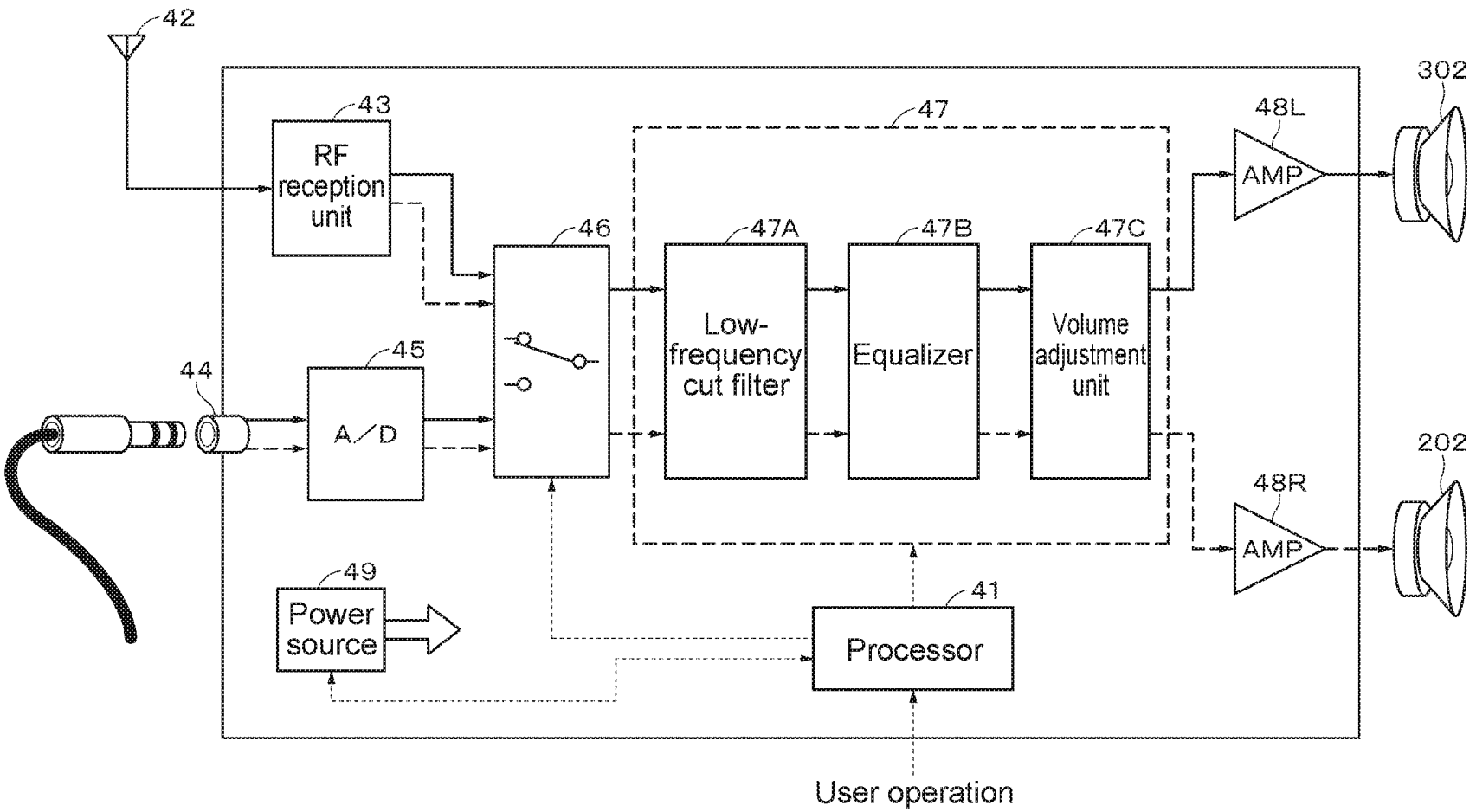
[FIG. 16]

Next, an electrical configuration of the neck speaker 100 will be described with reference to the block diagram of FIG. 16. In FIG. 16, the solid line indicates the audio signal of the L (Left) channel, the thick dotted line indicates the audio signal of the R (Right) channel, and the thin dotted line indicates a control signal or a command.

The neck speaker 100 includes a processor 41, an antenna 42, an RF (Radio Frequency) reception unit 43, an input terminal 44, an A/D (Analog to Digital) conversion unit 45, an input switching unit 46, a digital signal processing unit 47, an amplifier (AMP) 48L, an amplifier 48R, and a power source 49.

The processor 41 includes, for example, a CPU (Central Processing Unit). Further, the processor 41 includes a ROM (Read Only Memory) in which a program to be executed by the processor 41 is stored, a RAM (Random Access Memory) used as a work area, and the like. The processor 41 controls the respective units of the neck speaker 100. For example, a user operation of instructing reproduction or stop of audio, or the like is performed to the operation input unit (not shown) provided in the neck speaker 100. The operation signal generated in accordance with the user operation is input to the processor 41. The processor 41 analyzes the content of the operation signal, and executes control according to the operation signal.

The antenna 42 receives a two-channel audio signal transmitted from an external electronic apparatus in accordance with a predetermined wireless communication standard. Examples of the external electronic apparatus include a personal computer, a smartphone, and a portable audio reproduction apparatus. Further, examples of the predetermined wireless communication standard include a wireless LAN (Local Area Network), Bluetooth (registered trademark), WiFi (registered trademark), and infrared communication.

The audio signal received by the antenna 42 is supplied to an RF reception unit 43. The RF reception unit 43 performs demodulation processing, error correction processing, and the like on the input audio signal. The signal processed by the RF reception unit 43 is supplied to the input switching unit 46.

The input terminal 44 is a terminal for connecting the neck speaker 100 and the external electronic apparatus by wire. The audio signal may be taken into the neck speaker 100 via the input terminal 44.

The A/D conversion unit 45 converts the analog audio signal taken via the input terminal 44 into a digital audio signal.

The input switching unit 46 is a switch for switching between the input of the audio signal from the RF reception unit 43 and the input of the audio signal from the input terminal 44. The input switching unit 46 switches the input in accordance with the control of the processor 41, for example. The audio signal selected by the input switching unit 46 is supplied to the digital signal processing unit 47.

The digital signal processing unit 47 includes, for example, a DSP (Digital Signal Processor). The digital signal processing unit 47 includes, for example, a low-frequency cut filter 47A, an equalizer 47B, and a volume adjustment unit 47C. The low-frequency cut filter 47A is a filter that cuts low-frequency components contained in the audio signal. The equalizer 47B corrects the frequency characteristics of the audio signal, and includes, for example, a secondary IIR (Infinite Impulse Response) filter. The volume adjustment unit 47C adjusts the volume of the sound reproduced from the speaker unit 202 or 302 by adjusting the level of the audio signal.

Among the audio signals on which the signal process by the digital signal processing unit 47 has been performed, the left channel audio signal is supplied to the amplifier 48L. The audio signal amplified by the amplifier 48L with a predetermined amplification factor is reproduced from the speaker unit 302. Among the audio signals on which the signal process by the digital signal processing unit 47 has been performed, the right channel audio signal is supplied to the amplifier 48R. The audio signal amplified by the amplifier 48R with a predetermined amplification factor is reproduced from the speaker unit 202.

The power source 49 includes, for example, a secondary battery such as a lithium ion battery, and a circuit for charging and discharging, and the like. The power source 49 is not limited to a secondary battery, and may include a primary battery, an electric double layer capacitor, a lithium ion capacitor, or the like.

For example, the processor 41, the RF reception unit 43, the input switching unit 46, the digital signal processing unit 47, the amplifier 48L, the amplifier 48R, and the power source 49 constitute a signal processing unit. The signal processing unit is accommodated in, for example, the speaker box 201. The signal processing unit may be accommodated in the speaker box 301. As a result, it is possible to reduce the size of the neck speaker 100. As described above, the neck speaker 100 is also a reproduction apparatus that reproduces an audio signal.

Operation Example of Neck Speaker

Next, an operation example of the neck speaker 100 will be described. When an audio signal is supplied to the neck speaker 100, the diaphragm of the speaker unit 202 or 302 vibrates, and sound is generated. Further, the sound pressure generated by the vibration of the speaker unit 202 or 302 radiates in the audio space 201C or 301C, and the sound pressure causes the passive radiator 203 or 303 to vibrate in the horizontal direction, which generates a low-frequency sound. The passive radiator 203 or 303 repeatedly vibrates in the positive direction (side opposite to the inner side of the speaker box 201 or 301) and in the negative direction (inner side of the speaker box 201 or 301).

The passive radiator 203 or 303 vibrates, and thus, the low-frequency components of the reproduced sound are enhanced. Further, the vibration generated by the operation of the passive radiator 203 or 303 propagates to the vicinity of the shoulder of the listener L via the speaker box 201 or 301. Since the vibration propagates to the body of the listener L, it is possible to provide low-frequency feeling and realistic feeling to the listener L more.

The sound reproduced from the speaker unit 202 is reflected by the wall unit 210C forming the sound guiding space 210B. The periphery of the sound guiding space 210B except for the aperture unit 210D is shielded by the wall unit 210C.b Therefore, the energy of the sound reproduced from the speaker unit 202 is reflected by the wall unit 210C, and propagates toward the aperture unit 210D. In this manner, the radiation direction of the sound reproduced from the speaker unit 202 by the sound guiding unit 210 is converted from the right and left directions (direction from the inside to the outside in this example) into the upward and downward directions (upward in this example).

Here, since the aperture unit 210D is formed along the longitudinal direction of the casing 210A, the sound reproduced from the speaker unit 202 radiates over a wide range via the aperture unit 210D. Even in the case where the position of the speaker unit 202 deviates in forward and backward directions or upward and downward directions (rotation direction) depending on the user's body shape, physique, or the like, as described above, sound can be reproduced in the direction of the ear of the listener L. This applies also to the speaker unit 302.

Note that there can also be a listener L who likes less vibration propagating the shoulder. In this regard, the neck speaker 100 according to the embodiment is configured such that the magnitude of the vibration can be adjusted. For example, an input operation for reducing the vibration by the listener L is performed. In response to this input operation, the digital signal processing unit 47 operates the low-frequency cut filter 47A to cut the low-frequency components contained in the audio signal. As a result, the vibration of the speaker box 201 or 301 when the sound is reproduced is weakened, and as a result, the vibration of the passive radiator 203 or 303 is reduced. Therefore, it is possible to reduce the vibration propagating to the vicinity of the shoulder of the listener L. In contrast, by stopping the operation of the low-frequency cut filter 47, it is possible to increase the vibration of the passive radiator 203 or 303, and increase the vibration propagating to the vicinity of the shoulder of the listener L. Note that by making the cutoff frequency of the low-frequency cut filter 47A variable, the magnitude of the vibration propagating to the shoulder of the listener L may be adjusted in multiple levels.

[Effect by Using Passive Radiator]

As describe above, in the neck speaker 100 according to the embodiment uses the passive radiators 203 and 303. An example of the effect obtained by using the passive radiators 203 and 303 will be described with reference to FIGS. 17A, 17B, 17C, 17D, 18A, and 18B.

Figure 17C:
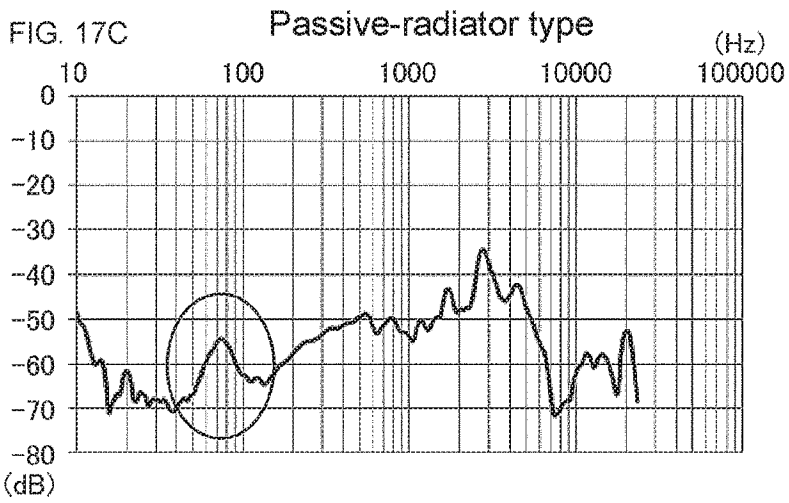
[FIGS. 17A, 17B, 17C, and 17D]
Figure 17D:
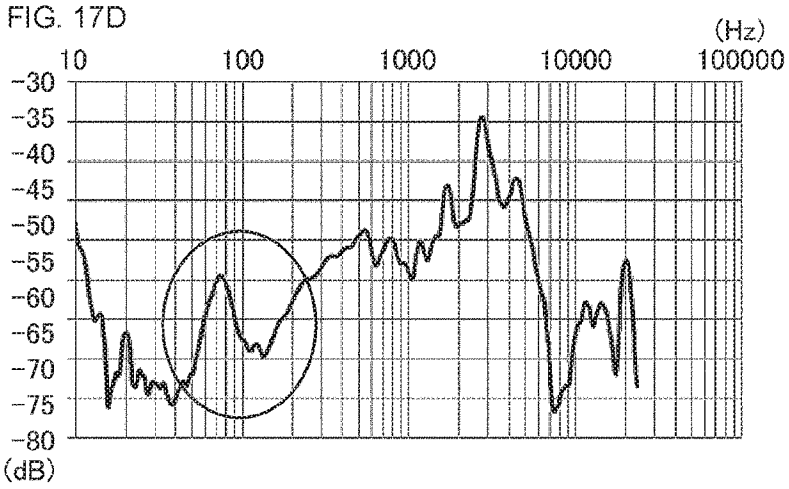
Figure 17A:
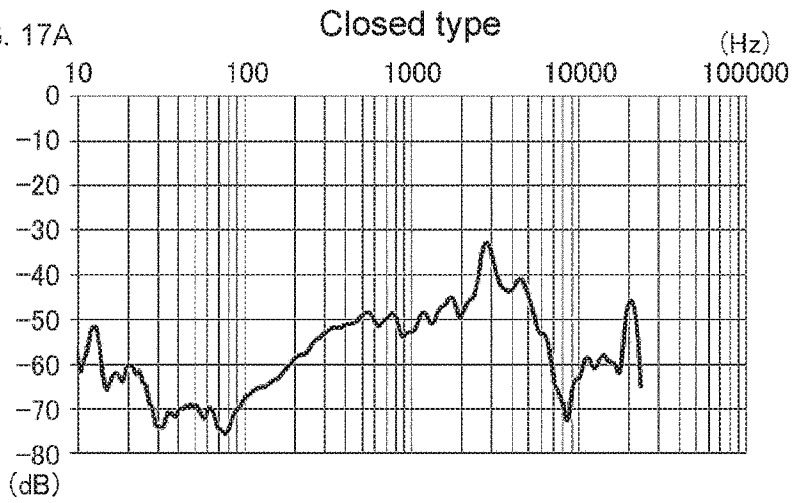
Figure 17B:
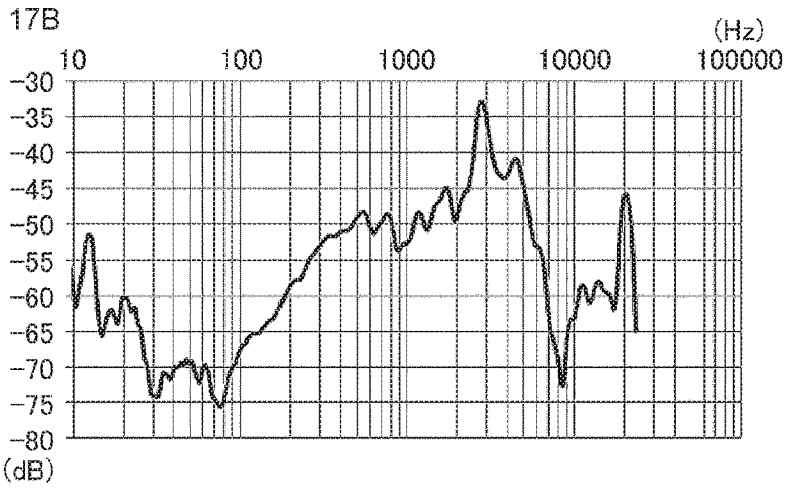

FIG. 17A is a diagram showing the frequency characteristics of a closed type neck speaker that includes a speaker box of the same capacity (e.g., approximately 30 cc to 60 cc) as that of the neck speaker 100 according to the embodiment, and no passive radiator. In FIG. 17A (the same applies also to FIGS. 17B, 17C, and 17D), the horizontal axis indicates the frequency (Hz) and the vertical axis indicates the gain (dB) of sound pressure measured a microphone. FIG. 17B is an enlarged view of the vicinity of −30 dB to −80 dB FIG. 17A. FIG. 17C is a diagram showing the frequency characteristics of a passive-radiator type neck speaker 100 including a passive radiator. FIG. 17D is an enlarged view of the vicinity of −30 dB to −80 dB in FIG. 17C.

Comparing FIG. 17A and FIG. 17C, and FIG. 17B and FIG. 17D, the gain in the low-frequency region (e.g., in the vicinity of 60 Hz to 100) increases. In other words, by using a passive radiator, it is possible to enhance the low-frequency region.

Figure 18A:
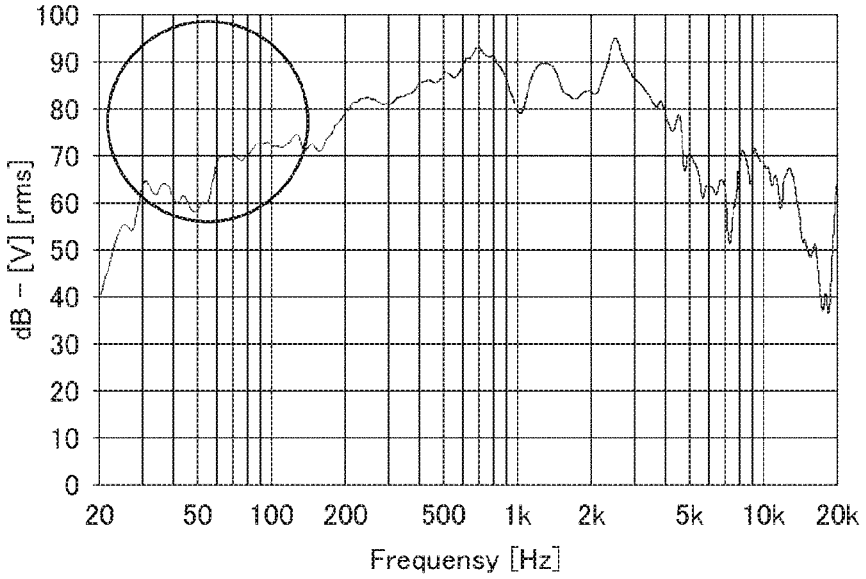
[FIGS. 18A and 18B]
Figure 18B:
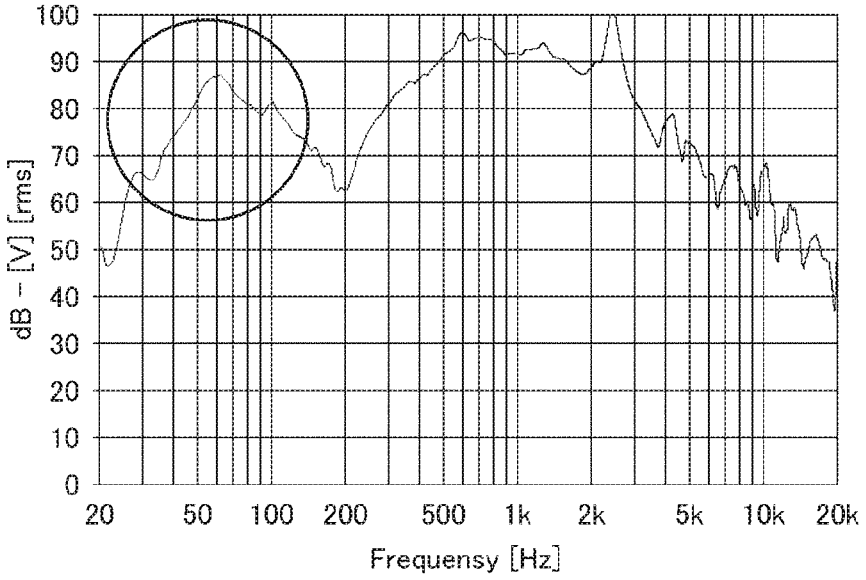

FIG. 18A is a diagram showing the characteristics of acceleration generated from the speaker box of the closed type neck speaker. Further, FIG. 18B is a diagram showing the characteristics of acceleration generated from the passive-radiator type neck speaker 100. In FIGS. 18A and 18B, the horizontal axis indicates the frequency and the vertical axis indicates the magnitude of acceleration. The acceleration was measured by installing an acceleration sensor in the vicinity of the shoulder of a listener (which may be a doll or the like for measurement).

Comparing FIG. 18A and FIG. 18B, in the passive-radiator type neck speaker 100, it can be confirmed that a system with a passive radiator generates large acceleration of approximately 20 dB at the maximum in the low-frequency region of not more than 100 Hz, as compared with the closed type neck speaker. This acceleration makes it possible to give sufficient vibration to the listener L, and it is possible to provide low-frequency feeling and realistic feeling accompanying the vibration. This effect can be said to be a unique effect in the case of applying a passive radiator having sufficient excitation to the neck speaker 100.

As described above, by applying a passive radiator known in the acoustic field to the neck speaker 100, a new effect can be achieved in addition to the acoustic effect. Further, the passive radiators 203 and 303 can be configured by merely mounting then on a part of the outer wall of the speaker boxes 201 and 301 of the neck speaker 100, respectively. In other words, in accordance with the configuration of the neck speaker 100 according to the embodiment, it is unnecessary to provide devices (e.g., actuators) for generating vibration unrelated to sound, and a space for mounting the devices is not required. Therefore, it is possible to realize the neck speaker 100 that exhibits the above-mentioned effect at low cost without increasing the size and weight.

Effect of Embodiment

The neck speaker 100 according to the embodiment has been described heretofore. In accordance with the neck speaker 100 according to the embodiment, in addition to the effects exemplified in the above description, for example, the following effects can be achieved.

Since the speaker units 202 and 302 are arranged so that the horizontal direction (e.g., outside) is the radiation direction of sound, the thicknesses of the right-side speaker unit 20 and the left-side speaker unit 30 can be reduced.

The speaker units 202 and 302 are respectively provided on the front side of the speaker boxes 201 and 301. As a result, the center of gravity in the attached status is on the front side, it is possible to prevent the neck speaker 100 from falling to the rear side of the listener L, and improve the attachment feeling. Further, since the passive radiators 203 and 303 are attached to spaces generated on the rear side of the speaker boxes 201 and 301 by the offset arrangement of the speaker units 202 and 302, respectively, it is possible to effectively utilize the spaces.

4. Modified Example

Although an embodiment of the present technology has been specifically described above, the present technology is not limited to the embodiment, and various modifications can be made on the basis of the technical idea of the present technology. Hereinafter, a plurality of modified examples will be described.

Figure 19:
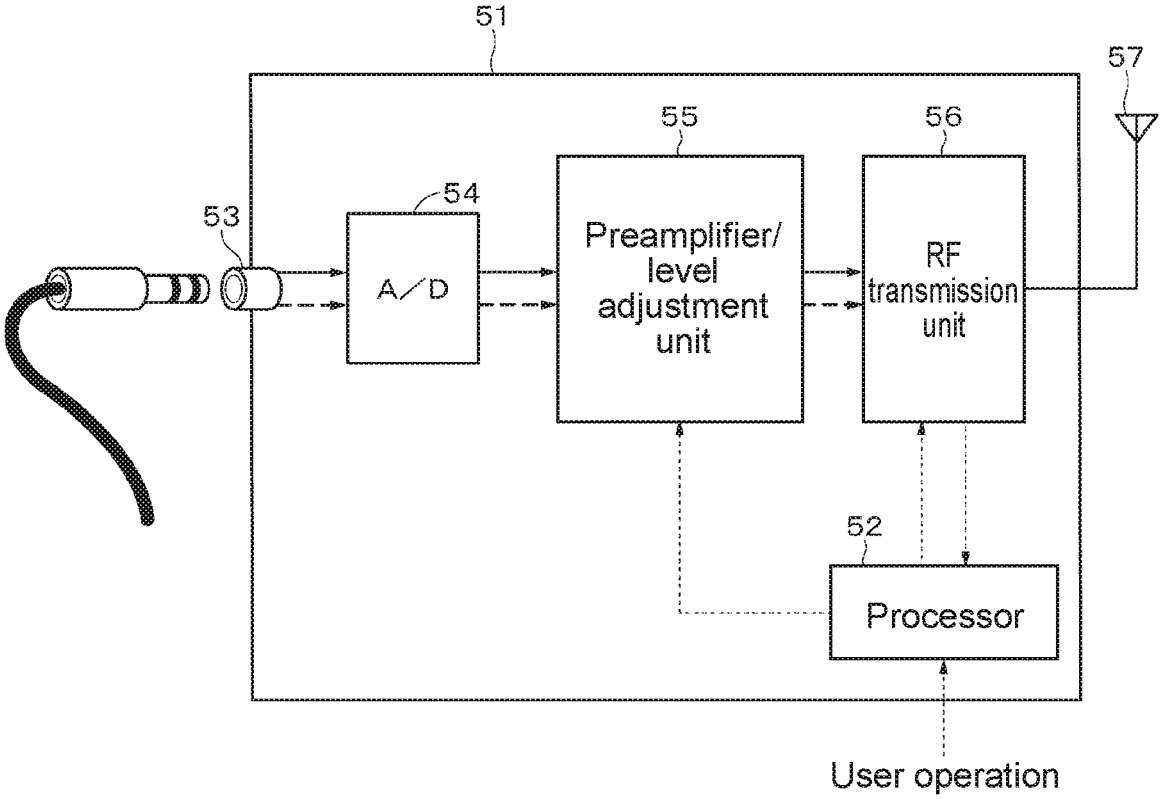
[FIG. 19]

The operation input to the neck speaker 100 and supply of the audio signal may be performed via a portable control apparatus. FIG. 19 is a block diagram showing a configuration example of a portable control apparatus 51. The control apparatus 51 includes a processor 52, an input terminal 53, the A/D conversion unit 54, a preamplifier/level adjustment unit 55, an RF transmission unit 56, and an antenna 57.

The configuration and operation of the control apparatus 51 will be schematically described. The processor 52 controls the respective unit of the control apparatus 51. The input terminal 53 is an interface with an external electronic apparatus. The A/D conversion unit 54 converts an analog signal input via the input terminal 53 into a digital signal. The preamplifier/level adjustment unit 55 amplifies and adjusts the level of the audio signal. The RF transmission unit 56, for example, modulates the audio signal and a command in a predetermined format. The antenna 57 communicates with the neck speaker 100 (e.g., short-range wireless communication).

For example, an operation input by a user is performed using the control apparatus 51. The processor 52 generates an operation signal corresponding to the operation input, and supplies it to the RF transmission unit 56. The RF transmission unit 56, for example, modulates the operation signal in accordance with a predetermined communication standard, and transmits it to the neck speaker 100 via the antenna 57. The neck speaker 100 that has received the operation signal performs processing corresponding to the operation signal.

An audio signal may be transmitted from the control apparatus 51 to the neck speaker 100. For example, an analog audio signal is input from an external electronic apparatus to the control apparatus 51 via the input terminal 53. The analog audio signal is converted into a digital audio signal by the A/D conversion unit 54. After the level of the audio signal is adjusted by the preamplifier/level adjustment unit 55, for example, the audio signal is modulated in a predetermined format by the RF transmission unit 56. Then, the audio signal on which modulation or the like has been performed is transmitted to the neck speaker 100 via the antenna 57.

Figure 20:
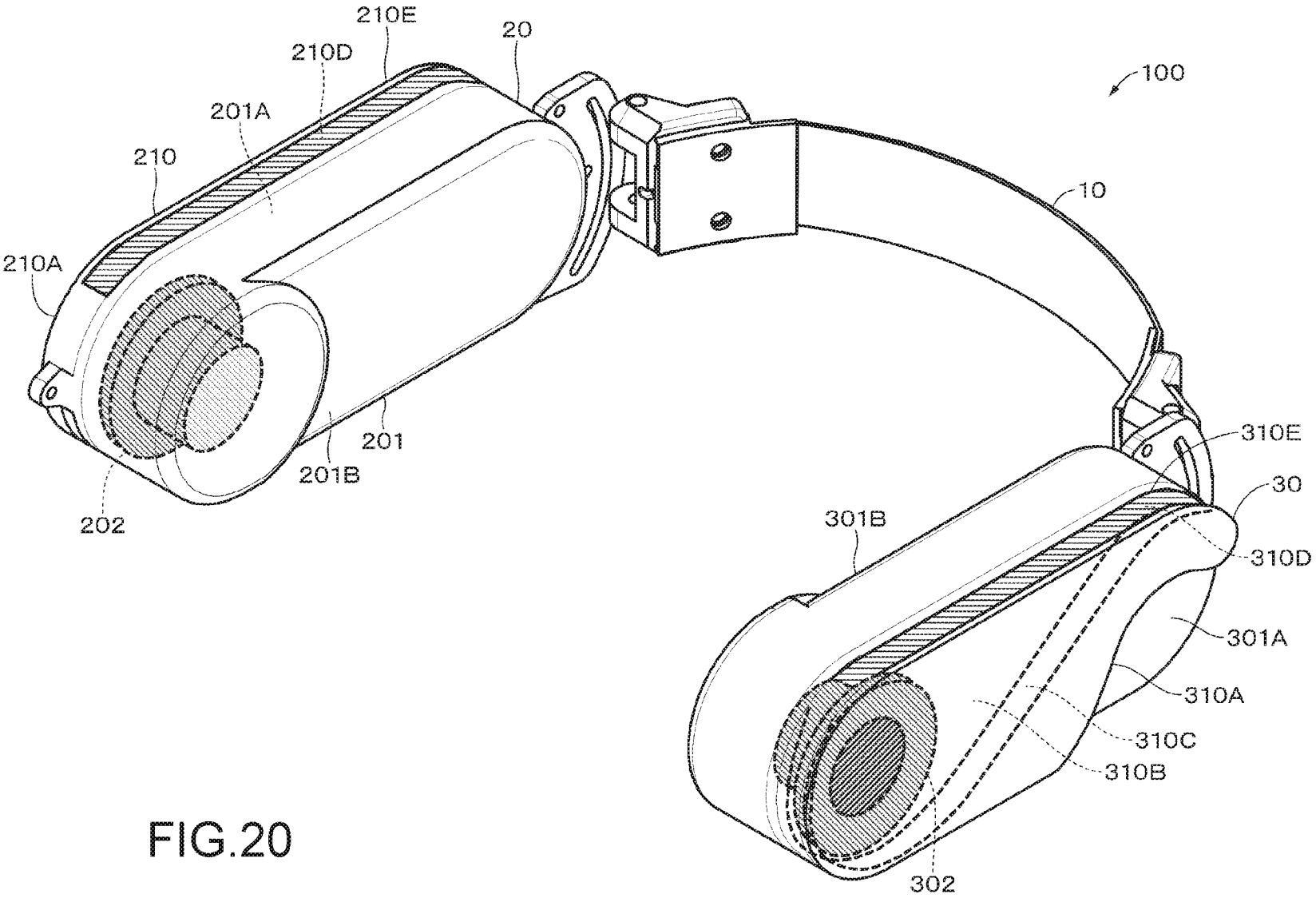
[FIG. 20]

Although it is favorable that the neck speaker includes a passive radiator as described in the above-mentioned embodiment, the present technology is not limited to such a configuration, and it does not necessarily need to provide a passive radiator in the neck speaker 100 according to the embodiment, as shown in FIG. 20.

Figure 21B:
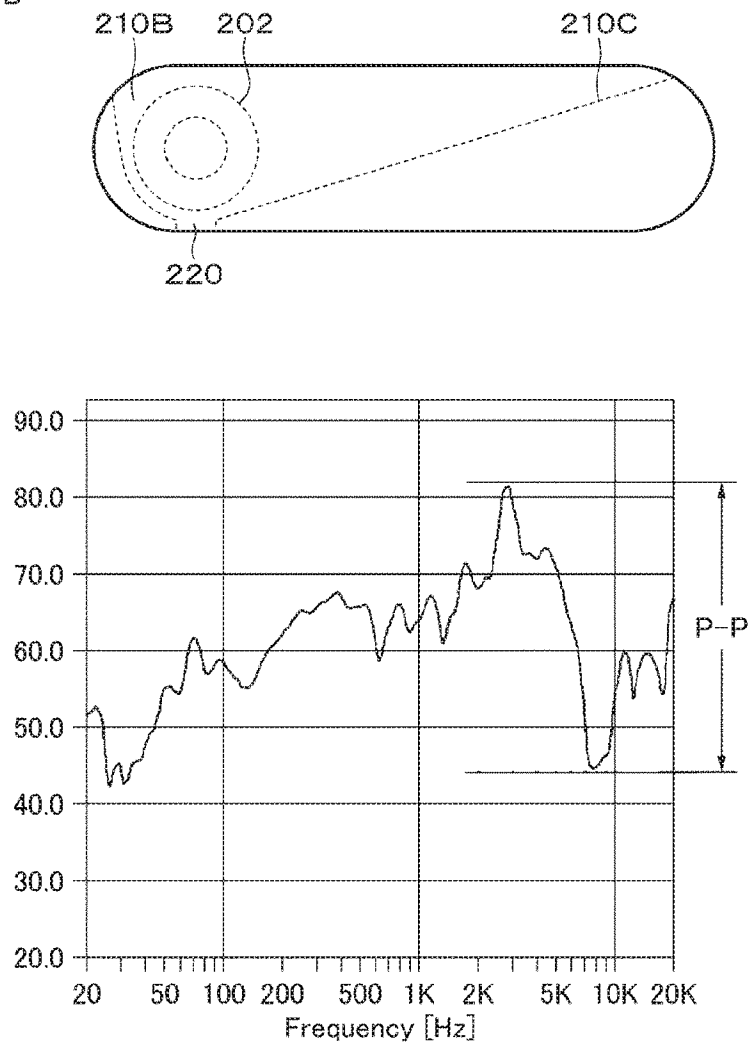
[FIGS. 21A and 21B]
Figure 21A:
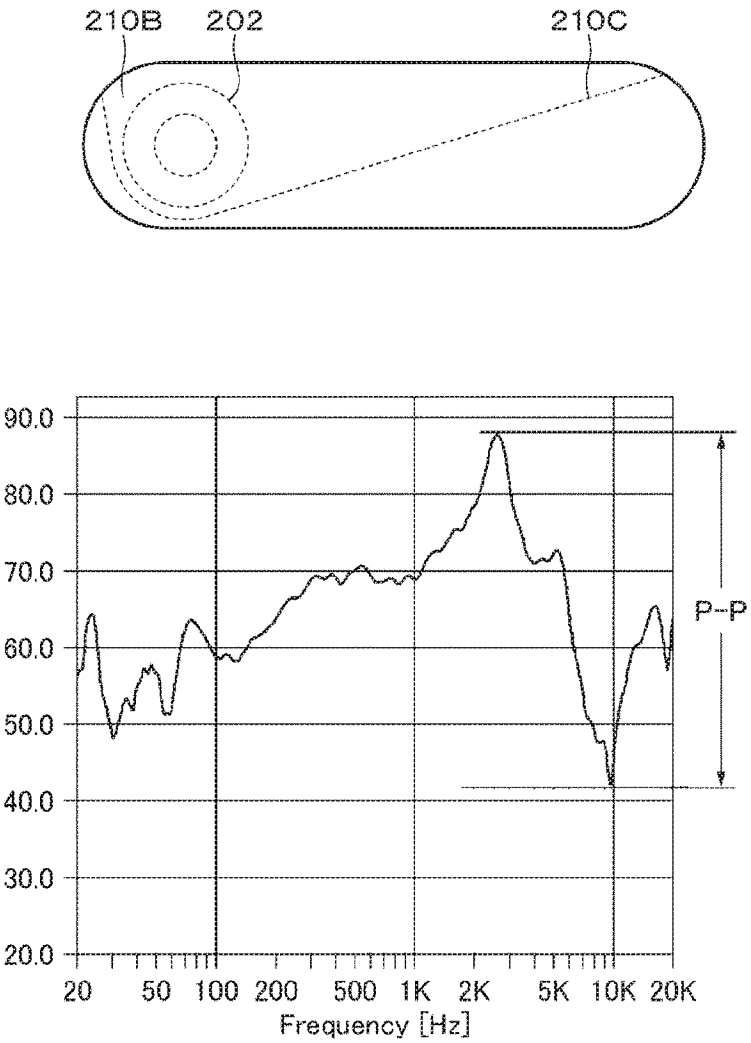

A hole unit may be formed in a part of the wall unit 210C. FIG. 21A is a diagram showing a configuration in which the wall unit 210C in the sound guiding space 210B includes no hole unit and the frequency characteristics when sound is reproduced by the configuration. FIG. 21B is a diagram showing a configuration in which a hole unit 220 is formed in the vicinity of a bottom part of the wall unit 210C, for example, and the frequency characteristics when sound is reproduced by the configuration. Note that the frequency characteristics were measured by placing a microphone at the position of the ear in the attached status. Comparing FIG. 21A and FIG. 21B, it is possible to reduce the P-P (Peak to Peak) of the sound pressure level indicated by the vertical axis, and suppress so-called rampage of sound. This is considered due to weakened resonance by providing the hole unit 220.

Figure 22:
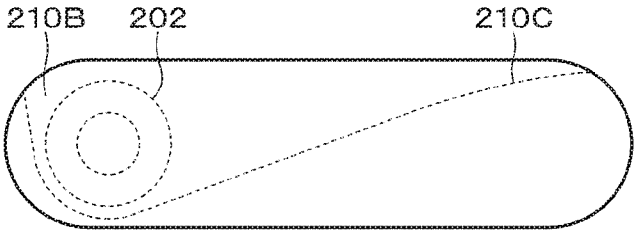
FIG. 22 is a diagram for describing a modified example.

As shown in FIG. 22, the wall unit 210C may tilt so as to draw a curve (bow-shape) instead of linear tilt, and the tilt of the wall unit 210C may have a curved surface.

The present technology may be a neck speaker including a speaker unit and a passive radiator attached to the same speaker box. For example, the above-mentioned neck speaker 100 according to the embodiment may include the speaker box 201, the speaker unit 202 and the passive radiator 203 attached to the speaker box 201, the speaker box 301, and the speaker unit 302 and the passive radiator 303 attached to the speaker box 301. Note that in the configuration, there may be or may not be a configuration related to the sound guiding units 210 and 310 according to the embodiment.

As described above, in the neck speaker 100, a part of the wall unit 210C facing the sound radiation surface of the speaker unit 202 does not necessarily need to be in parallel with the sound radiation surface, and may tilt (may be oblique). Further, the shape of the aperture unit 210D is not limited to the rectangular shape, and may be a circular shape, an elliptical shape, a polygonal shape, or the like.

As described above, in the neck speaker 100, the right and left speaker units may each include a plurality of speaker units. Note that as described above, since the cost increases by the amount corresponding thereto, and also the weight of the neck speaker increases, it is favorable to employ the configuration of the neck speaker according to the embodiment.

In the above-mentioned embodiment, the diaphragm is not limited to a corn diaphragm, and may be a flat diaphragm or the like. Further, as described above, in the neck speaker 100, a configuration (not shown) may be added. For example, a storage unit that stores an audio signal, a display unit, or the like may be added to the neck speaker 100. The storage unit may be a memory incorporated in the neck speaker 100, or a memory detachably attached to the neck speaker 100.

In the above-mentioned embodiment, a neck speaker has been described as an example of the wearable speaker. However, the present technology is not limited thereto. The wearable speaker only needs to be an open type speaker apparatus that reproduces sound near the ear without sealing the auricle, and may be, for example, a speaker apparatus applied to a head mount display attached to the head. In other words, the attached band is not limited to those hung on the neck, and may be one attached to the head or the arm.

The configurations, the methods, the steps, the shapes, the materials, and the numerical values cited in the above-mentioned embodiment are merely examples, and different configurations, methods, steps, shapes, materials, and numerical values may be used as necessary. The above-mentioned embodiment and modified examples can be appropriately combined.

The present technology may also take the following configurations.

(1)

A wearable speaker, including:

a pair of speaker boxes that are attached on both ends of an attached band; and a speaker unit and a passive radiator that are attached on each of the speaker boxes.

(2)

The wearable speaker according to (1), in which the attached band has a U-shape, and the speaker unit is attached on a first surface of each of the speaker boxes that faces an outside with respect to an ear of a listener in an attached status in which the attached band is hung on a neck of the listener, and the passive radiator is attached on a second surface of each of the speaker boxes that faces an inside with respect to the ear of the listener in the attached status.

(3)

The wearable speaker according to (2), in which the speaker unit is attached on a position of the first surface that deviates forward from a center position in forward and backward directions based on the listener in the attached status, and the passive radiator is attached on a position of the second surface that deviates backward from the center position in the forward and backward directions based on the listener in the attached status.

(4)

The wearable speaker according to (2) or (3), further including a sound guiding unit that converts a radiation direction of a sound reproduced from the speaker unit.

(5)

The wearable speaker according to (4), in which the sound guiding unit includes a sound guiding space that is connected with a sound radiation surface of the speaker unit, a wall unit that forms the sound guiding space, and an aperture unit that radiates the sound from the sound guiding space.

(6)

The wearable speaker according to (5), in which a part of the wall unit tilts from a front side to a back side.

(7)

The wearable speaker according to (6), in which the tilt of the wall unit includes a curved surface.

(8)

The wearable speaker according to any one of (5) to (7), in which a hole unit is formed on a part of the wall unit.

(9)

The wearable speaker according to (1), in which the attached band is a neck hanging unit that is attached on a neck.

(10)

The wearable speaker according to any one of (1) to (9), in which the wearable speaker is configured to be capable of adjusting a vibration that is produced by operating the passive radiator.

(11)

A reproduction apparatus, including:

a signal processing unit that processes an audio signal; and a wearable speaker, in which the wearable speaker includes a pair of speaker boxes that are attached on both ends of an attached band, and a speaker unit and a passive radiator that are attached on each of the speaker boxes.

(12)

The reproduction apparatus according to (11), in which the signal processing unit is accommodated in each of the speaker boxes.

REFERENCE SIGNS LIST

10 neck hanging unit
20 right-side speaker unit
30 left-side speaker unit
100 neck speaker
201, 301 speaker box
201A, 301A (outside) side surface
201B, 301B (inside) side surface
202, 302 speaker unit
203, 303 passive radiator
210, 310 sound guiding unit
210B, 310B sound guiding space
210C, 310C wall unit
210D, 310D aperture unit
220 hole unit

The invention claimed is:

1. A wearable speaker, comprising:

a pair of speaker boxes, wherein one speaker box of the pair of speaker boxes is attached on each end of an attached band;

a speaker unit on a first surface of each speaker box of the pair of speaker boxes;

a passive radiator on a second surface of each speaker box of the pair of speaker boxes, wherein the first surface is opposite to the second surface; and a sound guiding unit configured to convert a radiation direction of a sound reproduced from the speaker unit, wherein the sound guiding unit includes a wall unit and a sound guiding space formed by the wall unit, a part of the wall unit tilts from a third surface of the respective speaker box of the pair of speaker boxes to a fourth surface of the respective speaker box of the pair of speaker boxes, a length of the sound guiding space in a height direction decreases from the third surface to the fourth surface based on the tilt of the wall unit from the third surface to the fourth surface, the sound guiding space that faces the speaker unit has a maximum length in the height direction, and the third surface is opposite to the fourth surface.

2. The wearable speaker according to claim 1, wherein the attached band has a U-shape, the first surface of each speaker box of the pair of speaker boxes faces outside with respect to an ear of a listener in an attached status, in the attached status the attached band is hung on a neck of the listener, and the second surface of each speaker box of the pair of speaker boxes faces inside with respect to the ear of the listener in the attached status.

3. The wearable speaker according to claim 2, wherein the speaker unit is on a position of the first surface, the position of the first surface deviates in a first direction from a center position of each speaker box of the pair of speaker boxes based on the listener in the attached status, the passive radiator is on a position of the second surface, and the position of the second surface deviates in a second direction from the center position based on the listener in the attached status.

4. The wearable speaker according to claim 1, wherein the sound guiding unit further includes an aperture, the sound guiding space is connected with a sound radiation surface of the speaker unit, and the aperture is on a fifth surface different from each of the third surface and the fourth surface and is configured to radiate the sound from the sound guiding space.

5. The wearable speaker according to claim 1, wherein the tilt of the wall unit has a curved surface.

6. The wearable speaker according to claim 1, wherein the wall unit includes a hole.

7. The wearable speaker according to claim 1, wherein the attached band is a neck hanging unit that is attachable on a neck of a listener of the wearable speaker.

8. The wearable speaker according to claim 1, wherein the wearable speaker is configured to adjust a magnitude of a vibration produced based on an operation of the passive radiator.

9. A reproduction apparatus, comprising:

a signal processing unit configured to process an audio signal; and a wearable speaker that includes:

a pair of speaker boxes, wherein one speaker box of the pair of speaker boxes is attached on each end of an attached band;

a speaker unit on a first surface of each speaker box of the pair of speaker boxes;

a passive radiator on a second surface of each speaker box of the pair of speaker boxes, wherein the first surface is opposite to the second surface; and a sound guiding unit configured to convert a radiation direction of a sound reproduced from the speaker unit, wherein the sound guiding unit includes a wall unit and a sound guiding space formed by the wall unit, a part of the wall unit tilts from a third surface of the respective speaker box of the pair of speaker boxes to a fourth surface of the respective speaker box of the pair of speaker boxes, a length of the sound guiding space in a height direction decreases from the third surface to the fourth surface based on the tilt of the wall unit from the third surface to the fourth surface, the sound guiding space that faces the speaker unit has a maximum length in the height direction, and the third surface is opposite to the fourth surface.

10. The reproduction apparatus according to claim 9, wherein the signal processing unit is accommodated in one of speaker box of the pair of speaker boxes.

* * * * *